US010088796B2

(12) United States Patent
Ishida et al.

(10) Patent No.: US 10,088,796 B2
(45) Date of Patent: Oct. 2, 2018

(54) ACOUSTIC DEVICE AND ELECTRONIC DEVICE AND IMAGE FORMING APPARATUS INCORPORATING SAME

(71) Applicants: Masahiro Ishida, Kanagawa (JP); Naoki Matsuda, Kanagawa (JP)

(72) Inventors: Masahiro Ishida, Kanagawa (JP); Naoki Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/159,908

(22) Filed: May 20, 2016

(65) Prior Publication Data

US 2016/0349695 A1 Dec. 1, 2016

(30) Foreign Application Priority Data

May 28, 2015 (JP) ..... 2015-109151

(51) Int. Cl.
*G10K 11/172* (2006.01)
*G03G 21/16* (2006.01)

(52) U.S. Cl.
CPC ..... *G03G 21/1619* (2013.01); *G10K 11/172* (2013.01)

(58) Field of Classification Search
CPC ..... G03G 21/1619; G10K 11/172
USPC ..... 181/198, 200, 202
See application file for complete search history.

(56) References Cited

U.S. PATENT DOCUMENTS 4,294,329 A * 10/1981 Rose ..... B32B 3/12 181/222
5,508,477 A 4/1996 Kato et al.
6,530,221 B1 3/2003 Sattinger et al.
8,424,636 B2 * 4/2013 Jones ..... F01N 1/006 181/212
9,343,059 B2 * 5/2016 Wilson ..... G10K 11/172
2004/0190928 A1 9/2004 Tsunoda et al.
(Continued)

FOREIGN PATENT DOCUMENTS

JP 7-181978 7/1995
JP H-08-083038 A 3/1996
(Continued)

OTHER PUBLICATIONS

English translation of WO 2012/144078, accessed Mar. 31, 2017, <https://patentscope.wipo.int/search/en/detail.jsf?docId=WO2012144078&recNum=2&maxRec=3&office=&prevFilter=&sortOption=Pub+Date+Desc&queryString=FP%3A%282012144078%29&tab=FullText#atapta0>.*
(Continued)

*Primary Examiner* — Jeremy Luks
(74) *Attorney, Agent, or Firm* — Harness, Dickey & Pierce, P.L.C.

(57) ABSTRACT

An acoustic device includes a first member; a second member; a cavity formed by joining the first member and the second member together; and a port to communicate the cavity with an outside. The port is disposed at a joint portion between the first member and the second member. The first member includes a bottom plate disposed opposite the second member with the cavity in between and a side wall extending from the bottom plate toward the second member, and an edge face of the side wall, opposite the bottom plate, contacts the second member, to form different cavities. The acoustic device further includes a hole that penetrates the side wall and a material of the second member has a density greater than that of the first member.

27 Claims, 14 Drawing Sheets

(56) References Cited

U.S. PATENT DOCUMENTS

| | | | | |
|---|---|---|---|---|
| 2005/0120776 | A1 | 6/2005 | Jenkins et al. | |
| 2005/0166596 | A1 | 8/2005 | Sattinger | |
| 2007/0034666 | A1 | 2/2007 | Holsten et al. | |
| 2007/0034668 | A1 | 2/2007 | Holsten et al. | |
| 2007/0125089 | A1 | 6/2007 | Sattinger | |
| 2007/0292261 | A1* | 12/2007 | Tang | F04D 25/08 415/119 |
| 2008/0035702 | A1 | 2/2008 | Holsten et al. | |
| 2008/0164297 | A1 | 7/2008 | Holsten et al. | |
| 2009/0030432 | A1 | 1/2009 | Holsten et al. | |
| 2009/0152324 | A1 | 6/2009 | Holsten et al. | |
| 2010/0108739 | A1 | 5/2010 | Holsten et al. | |
| 2010/0200641 | A1 | 8/2010 | Holsten et al. | |
| 2012/0125972 | A1 | 5/2012 | Holsten et al. | |
| 2013/0118831 | A1 | 5/2013 | Kawai et al. | |
| 2015/0110517 | A1 | 4/2015 | Ishida et al. | |
| 2015/0241838 | A1 | 8/2015 | Ishida et al. | |
| 2015/0243274 | A1 | 8/2015 | Hirakawa et al. | |
| 2015/0338761 | A1 | 11/2015 | Watanabe et al. | |
| 2015/0343816 | A1 | 12/2015 | Kawase et al. | |
| 2016/0033928 | A1 | 2/2016 | Ishimitsu et al. | |

FOREIGN PATENT DOCUMENTS

| | | | | | |
|---|---|---|---|---|---|
| JP | H-09-078539 | A | | 3/1997 | |
| JP | H-09-230658 | A | | 9/1997 | |
| JP | H11-24669 | A | | 1/1999 | |
| JP | 2000-235396 | | | 8/2000 | |
| JP | 2004361588 | A | * | 12/2004 | G02B 7/1821 |
| JP | 2013-200426 | | | 10/2013 | |
| JP | 2015-206978 | | | 11/2015 | |
| JP | 2015-219455 | | | 12/2015 | |
| WO | WO-2012/144078 | A1 | | 10/2012 | |

OTHER PUBLICATIONS

U.S. Appl. No. 14/947,474, filed Nov. 20, 2015.
U.S. Appl. No. 15/008,809, filed Jan. 28, 2016.
U.S. Appl. No. 15/010,758, filed Jan. 29, 2016.
U.S. Appl. No. 14/962,113, filed Dec. 8, 2015.
U.S. Appl. No. 14/978,890, filed Dec. 22, 2015.
European Search Report dated Oct. 5, 2016 issued in corresponding European Application No. 16171806.9.
Japanese Office Action dated Nov. 25, 2016 issued in corresponding Japanese Application No. 2015-109151.

* cited by examiner

ACOUSTIC DEVICE AND ELECTRONIC DEVICE AND IMAGE FORMING APPARATUS INCORPORATING SAME

CROSS-REFERENCE TO RELATED APPLICATION

The present application claims priority pursuant to 35 U.S.C. § 119(a) from Japanese patent application number 2015-109151, filed on May 28, 2015, the entire disclosure of which is incorporated by reference herein.

BACKGROUND

Technical Field

Exemplary embodiments of the present invention relate to an acoustic device, and further relates to an electronic device and an image forming apparatus employing the acoustic device.

Background Art

In a typical image forming apparatus employing the electrophotographic method of image formation, various sounds are generated when various driving devices are driven or a polygon mirror is rotated. Typically, an acoustic device employing a Helmholtz resonator as a structure capable of absorbing sounds generated during image formation is used to absorb that noise.

In the above acoustic device, a plate member that forms one face of a cavity of the Helmholtz resonator and another member that forms another face of the cavity are joined together. The plate member includes a through-hole in the depth direction of the plate member, and this through-hole serves as a port of the Helmholtz resonator.

SUMMARY

This disclosure describes an acoustic device including a first member; a second member; a cavity formed by joining the first member and the second member together; and a port to communicate the cavity with an outside, in which the port is disposed at a joint portion between the first member and the second member.

This disclosure further describes an acoustic device including a first member; a second member; a cavity formed by joining the first member and the second member together; and a port to communicate the cavity with an outside, in which the first member includes a bottom plate opposed to the second member with the cavity in between and a side wall extending from the bottom plate toward the second member, and an edge face of the side wall, opposite the bottom plate, contacts the second member, to thereby form the cavity. The acoustic device further includes a hole that penetrates the side wall, and a material of the second member has a density greater than that of the first member.

This disclosure further describes an acoustic device including a first member; a second member; a cavity formed by joining the first member and the second member together; and a port to communicate the cavity with an outside. In the acoustic device, the first member includes a bottom plate opposed to the second member with the cavity in between and a side wall extending from the bottom plate toward the second member. An edge face of the side wall, opposite the bottom plate, contacts a planar portion of the second member to thereby form the cavity. The acoustic device further includes a hole that penetrates the side wall, and a planar portion of the second member projects outward than the side wall having the hole.

This disclosure further describes an electronic device including an acoustic device according to the above disclosure and an image forming apparatus employing the electrophotographic method including a structure of the above electronic device.

These and other features and advantages of the present invention will become apparent upon consideration of the following description of the preferred embodiments of the present invention when taken in conjunction with the accompanying drawings.

BRIEF DESCRIPTION OF THE DRAWINGS

FIGS. 1A and 1B schematically illustrate an acoustic device according to an embodiment of the present invention, in which FIG. 1A is a cross-sectional side view and FIG. 1B is a cross-sectional view of the acoustic device along A-A line of FIG. 1;

FIGS. 5A and 5B each illustrate a cavity forming member, in which FIG. 5A is a side view and FIG. 5B is a bottom view;

FIGS. 6A and 6B each illustrate an acoustic device according to a second structure, in which FIG. 6A is a side cross-sectional view and FIG. 6B is a cross-sectional view along A-A line of FIG. 6A;

FIGS. 8A and 8B each illustrate an acoustic device according to a first embodiment of the present invention, in which FIG. 8A is a side cross-sectional view and FIG. 8B is a cross-sectional view along A-A line of FIG. 8A;

FIGS. 9A and 9B each illustrate an acoustic device according to a second embodiment, in which FIG. 9A is a side cross-sectional view and FIG. 9B is a cross-sectional view along A-A line of FIG. 9A;

FIGS. 10A and 10B each illustrate an acoustic device according to a third embodiment, in which FIG. 10A is a side cross-sectional view and FIG. 10B is a cross-sectional view along C-C line of FIG. 10A;

FIGS. 12A and 12B each illustrate an acoustic device according to a fourth embodiment, in which FIG. 12A is a side cross-sectional view and FIG. 12B is a cross-sectional view along A-A line of FIG. 12A;

FIGS. 17A and 17B each illustrate an acoustic device according to a comparative example, in which FIG. 17A is a side cross-sectional view and FIG. 17B is a cross-sectional view along A-A line of FIG. 17A.

DETAILED DESCRIPTION

Hereinafter, a first embodiment of an image forming apparatus (hereinafter, to be referred to simply as a copier 500) employing the electrophotographic method is described. In the present embodiment, a monochrome image forming apparatus is described as the copier 500; however, the present embodiment may be similarly applied to a color image forming apparatus.

Figure 2:
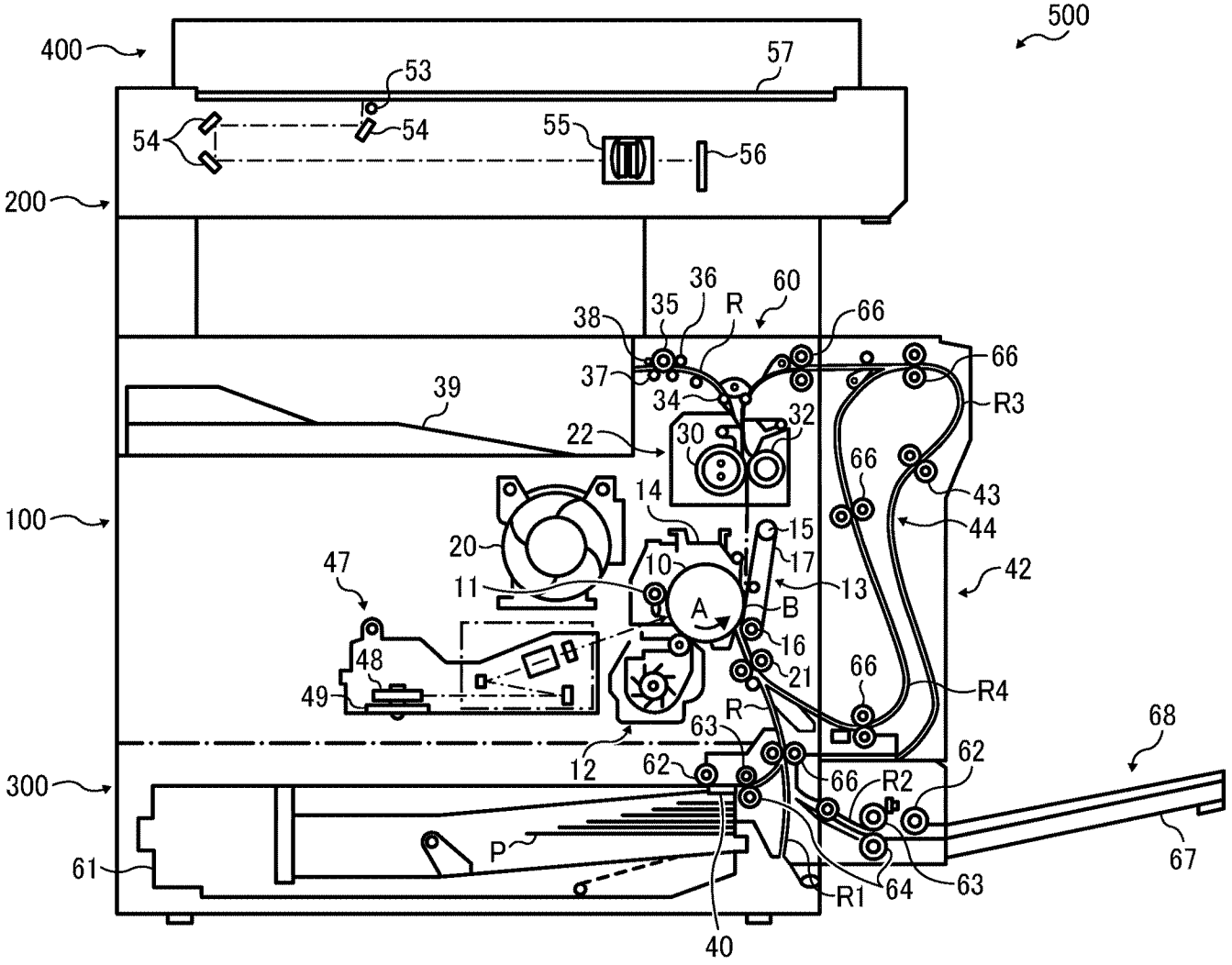
FIG. 2 schematically illustrates a copier as an image forming apparatus.

First, a configuration of the copier 500 will be described. FIG. 2 schematically illustrates the copier 500 as an image forming apparatus. As illustrated in FIG. 2, the copier 500 includes an image forming section 100; a scanner 200 disposed on top of the image forming section 100; and a sheet feeding device 300 disposed below the image forming section 100. An automatic document feeder (ADF) 400 to pivot about a rear side of the copier 500 in the figure is disposed on top of the scanner 200. A drum-shaped photoconductor 10 serving as a latent image carrier is disposed inside the image forming section 100. The photoconductor 10 rotates in a direction indicated by A in the figure.

Figure 3:
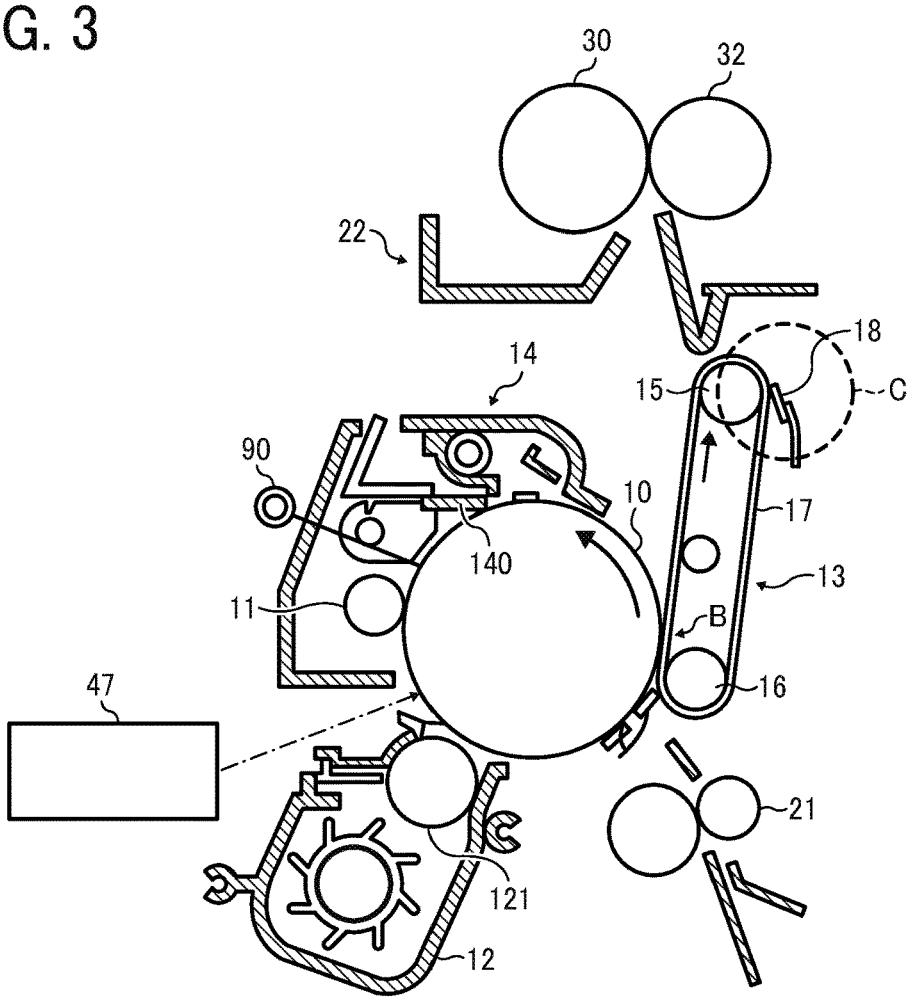
FIG. 3 is an enlarged view of a photoconductor and its peripheral parts.

FIG. 3 is an enlarged view of the photoconductor 10 and surrounding structure. As illustrated in FIG. 3, around the photoconductor 10, disposed are a neutralizer 90, a charger 11 employing a charge roller, a developing device 12, a transfer unit 13, and a cleaner 14 including a photoconductor cleaning blade 140. The developing device 12 includes a developing roller 121 serving as a developer bearer and causes the developing roller 121 to adhere toner on an electrostatic latent image on the photoconductor 10, to thereby render the latent image a visible image.

The transfer unit 13 includes a transfer belt 17 wound around two roller members, with tension, including a first belt tension roller 15 and a second belt tension roller 16. The transfer belt 17 is pressed against a peripheral surface of the photoconductor 10 at a transfer position B where a toner image on the photoconductor 10 is transferred to a sheet P as a recording medium.

A transfer belt cleaning position C is disposed downstream in a surface moving direction of the transfer belt 17 relative to the transfer position B. A belt cleaning blade 18 contacts the first belt tension roller 15 via the transfer belt 17 at the transfer belt cleaning position C.

As illustrated in FIG. 2, the image forming section 100 also includes a toner supply device 20 to supply new toner to the developing device 12. The toner supply device 20 is disposed on the left of the charger 11 and the cleaner 14 in the figure.

The image forming section 100 also includes a sheet conveyance device 60 to convey the sheet P fed out from a sheet feed cassette 61 of the sheet feeding device 300 to an ejected sheet stacker 39 via the transfer position B. The sheet conveyance device 60 conveys the sheet P along a feed path R1 or a manual feed path R2, and a sheet conveyance path R. A registration roller pair 21 is disposed on the sheet conveyance path R and upstream of the transfer position B in the sheet conveyance direction.

On the other hand, a thermal fixing device 22 is disposed on the sheet conveyance path R and downstream of the transfer position B in the sheet conveyance direction. The thermal fixing device 22 includes a heat roller 30 as a heating member and a pressure roller 32 as a pressurizing member, and performs fixing with heat and pressure with the sheet P nipped between the heating roller 30 and the pressure roller 32.

A bifurcation claw 34, an ejection roller 35, a first pressure roller 36, a second pressure roller 37, and a tightening roller 38 are disposed further downstream of the thermal fixing device 22. In addition, the ejected sheet stacker 39 in which the image-formed sheet P after passing though the thermal fixing device 22 is stacked is disposed.

The image forming section 100 further includes a switchback device 42 on the right in the figure. The switchback device 42 conveys the sheet P along a reversing path R3 bifurcated from the position of the bifurcation claw 34 on the sheet conveyance path R, and along a re-conveyance path R4 to lead the sheet P that has passed through the reversing path R3, to the position of the registration roller pair 21. A switchback roller pair 43 is disposed on the reversing path R3, and a plurality of sheet conveyance roller pairs 66 is disposed on the re-conveyance path R4.

As illustrated in FIG. 2, a laser writing device 47 is disposed on the left of the developing device 12. The laser writing device 47 is constructed of a scanning optical system including a laser light source, a rotary polygon mirror 48 for scanning, a polygon motor 49, and an fθ lens.

The scanner 200 includes a light source 53, a plurality of mirrors 54, a focusing optical lens 55, and an image sensor 56 such as a CCD image sensor, and a contact glass 57 is disposed on an upper surface of the scanner 200. In addition, the ADF 400 includes a document platen and a document stacker disposed at an ejection position of the document. The ADF 400 includes a plurality of document conveyance rollers that conveys the document from the document platen to the document stacker through a scanning position on the contact glass 57.

The sheet feeding device 300 includes the sheet feed cassette 61 to store the sheet P such as paper or OHP films. The sheet feed cassette 61 includes a sheet feed roller 62, a roller support board 40, a sheet feed roller 63, and a separation roller 64. The sheet feed roller 62 contacts a topmost sheet P of a sheet bundle stored in the sheet feed cassette 61 to apply a conveyance force to the sheet P.

The image forming section 100 includes a manual sheet feeder 68 on the right of FIG. 2. The manual sheet feeder 68 includes an openably closable manual tray 67, and the above-described manual conveyance path R2 leads the sheet P set on the manual tray 67 to the sheet conveyance path R. The manual sheet feeder 68 includes a sheet feed roller 62, a sheet feed roller 63, and a separation roller 64, similarly to the sheet feed cassette 61.

Next, operation of the copier 500 is described. In copying using the copier 500, first, a main switch is turned on and a document is set on the document platen of the ADF 400. When the document is a book, the ADF 400 is opened and the document is directly set on the contact glass 57, and then, the ADF 400 is closed to press the document from above.

Thereafter, when the start switch is pressed, the document set on the ADF 400 is moved onto the contact glass 57 after passing through the document conveyance path by the document conveyance roller, and the scanner 200 is started. When the content of the document has been scanned, the document is ejected onto the document stacker. On the other hand, when the document is directly set on the contact glass 57, the scanner immediately starts to scan the content of the document. In scanning the content of the image, the scanner 200 moves the light source 53 along the contact glass 57 and irradiates the surface of the document with the light from the light source 53. The reflected light from the document surface is led to the focusing optical lens 55 by the plurality of mirrors 54 to be input to the image sensor 56, which scans the content of the document.

Concurrently with the scanning of the document content, the copier 500 drives the photoconductor drive motor to rotate the photoconductor 10 and causes the charger 11 to uniformly charge a surface of the photoconductor at −1,000 volts environ, for example. Next, the copier 500 causes the laser writing device 47 to irradiate laser beams to the photoconductor 10 to perform laser writing based on the document content scanned by the scanner 200, to thereby form an electrostatic latent image on the surface of the photoconductor 10. The surface potential of a portion irradiated with the laser beams, i.e., the latent image portion, is from 0 volt to −200 volts, for example. Thereafter, the developing device 12 allows adhering toner to the electrostatic latent image, to thereby form a visible toner image.

Concurrently with the pressing of the start switch, the copier 500 causes the sheet feed roller 62 to feed the sheet P inside the sheet feed cassette 61 disposed in the sheet feeding device 300. The fed sheet P is separated one by one by the sheet feed roller 63 and the separation roller 64, and a piece of sheet P is led to the sheet conveyance path R1, and is led to the sheet conveyance path R by the sheet conveyance roller pair 66. The sheet P conveyed to the sheet conveyance path R is contacted the registration roller pair 21 and is stopped.

When the manual sheet feeder 68 is used, the manual tray 67 is opened and the sheet P is set on the manual tray 67. Similarly to the case of using the sheet feed cassette 61, a piece only of sheet P among the sheets P set on the manual tray 67 is conveyed to the sheet conveyance path R2 via the sheet feed roller 62, the sheet feed roller 63, and the separation roller 64, and is conveyed to the sheet conveyance path R via the sheet conveyance roller pair 66. The sheet P led to the sheet conveyance path R is contacted the registration roller pair 21 and is stopped. Thus, the registration roller pair 21 that has stopped the sheet P restarts to rotate at matched timing with which a leading end of the toner image on the photoconductor 10 enters the transfer position B, and feeds the stopped sheet P to the transfer position B.

The transfer unit 13 transfers the toner image on the photoconductor 10 to the sheet P that has fed to the transfer position B, and the sheet P bears the toner image on its surface thereof. After the above transfer process, the cleaner 14 removes residual toner remaining on the surface of the photoconductor 10, and the neutralizer 90 removes the residual electrical potential on the photoconductor 10. Upon removal of the residual potential, the surface potential is averaged at 0 volt to −150 volts as reference voltage, so that the photoconductor 10 is ready for a next image formation beginning from the charger 11.

On the other hand, the sheet P bears the toner image at the transfer position B and is conveyed by the transfer belt 17 to enter the thermal fixing device 22. The sheet receives heat and pressure while being conveyed between the heat roller 30 and the pressure roller 32, so that the toner image on the sheet P is fixed. Then, the sheet P is tightened by the ejection roller 35, the first pressure roller 36, the second pressure roller 37, and the tightening roller 38, and is ejected onto and is stored in the ejected sheet stacker 39.

When an image is formed on both sides of the sheet P, the bifurcation claw 34 is switched, and after the toner image is transferred and fixed on one side or a front side of the sheet P, the sheet P is fed to the reversing path R3 from the sheet conveyance path R. The sheet P fed into the reversing path R3 is conveyed by the sheet conveyance roller pair 66 and is fed to the switchback position 44. Then, the switchback roller pair 43 switches back the sheet P to lead the sheet P to the re-conveyance path R4, and the sheet conveyance roller pair 66 leads the sheet P again to the sheet conveyance path R. Thus, a toner image is transferred to a backside of the sheet P that has passed through the re-conveyance path R4, similarly to the description above.

As illustrated in FIG. 3, foreign materials such as residual toner or paper dust remaining on the transfer belt 17 after the sheet P is separated from the transfer belt 17 are scraped off from the transfer belt 17 by the belt cleaning blade 18 at the transfer belt cleaning position C.

In the present embodiment, the copier 500 as a monochrome image forming apparatus has been described heretofore; however, embodiments of the present invention may be similarly applied to a known color image forming apparatus.

The copier 500 generates various driving sound such as a polygon mirror and various drive motors to transmit rotary drive to various rollers. The copier 500 includes an acoustic device employing a Helmholtz resonator as a structure to absorb such driving sounds.

Figure 4:
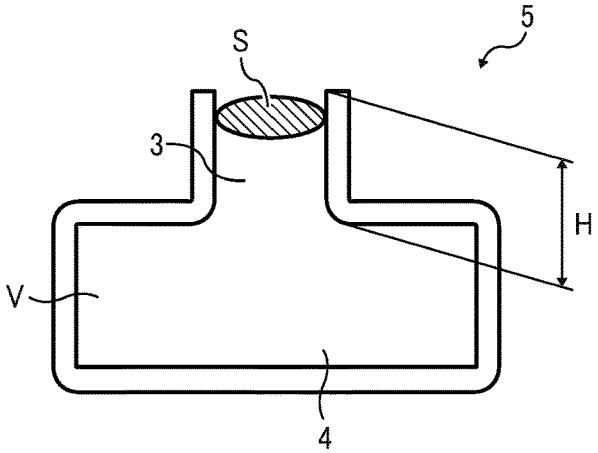
FIG. 4 schematically illustrates an acoustic device employing a Helmholtz resonator.

FIG. 4 schematically illustrates an acoustic device 5 employing the Helmholtz resonator. As illustrated in FIG. 4, the Helmholtz resonator includes a shape of a container with a reduced inlet. More specifically, the Helmholtz resonator includes a cavity 4 with a certain volume and a port 3 with a volume smaller than that of the cavity 4, and absorbs sounds at a certain frequency. If the volume of the cavity is V, a cross-sectional area of the port 3 is S, a length of the port 3 is H, and a speed of the sound is c, a resonant frequency f at the acoustic device 5 is obtained by the following formula (1):

$$f = \frac{c}{2\pi}\sqrt{\frac{S}{V(H+\Delta r)}} \tag{1}$$

Δr in the formula (1) is open-end correction and the Δr equals 0.6r in general when the cross section of the port 3 is a circle and r is a radius. As shown in the formula (1), the frequency of the sound absorbed by the acoustic device 5 can be obtained by the volume V of the cavity 4, the length H of the port 3, and the cross-section area S of the port 3.

In the copier 500, various sounds are generated not limited to the driving sound of the drive motor but also sounds of the moving parts such as various rollers, and rotary sounds of the polygon mirror 48 of the laser writing device 47. These operational sounds are emitted from the copier 500 as noise, which may cause discomfort to those around the copier 500. Among the operational sounds, which may be noisy, the acoustic device 5 is formed to absorb the frequency of the sound that is to be prevented from being emitted so that the operational sound that could be a noise may be absorbed by the acoustic device 5.

Figure 1A:
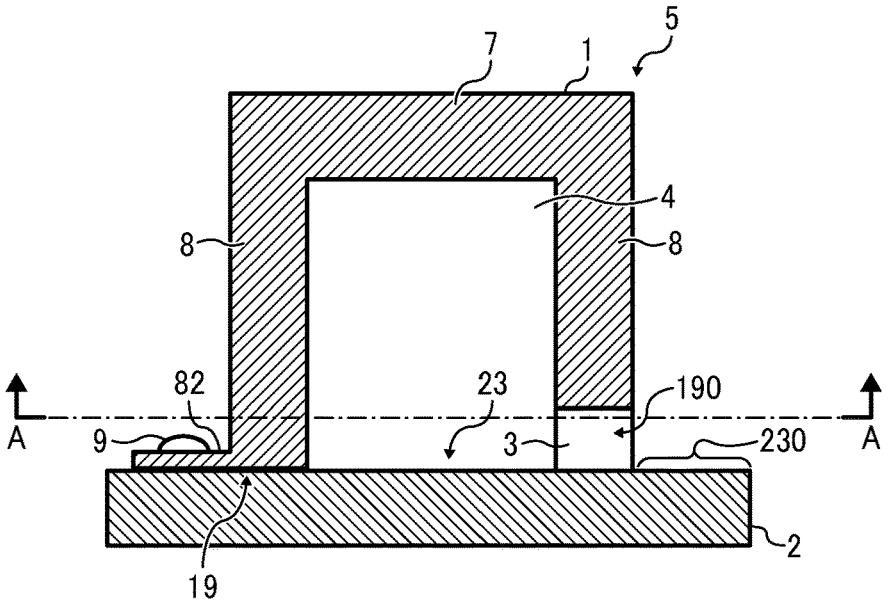
Figure 1B:
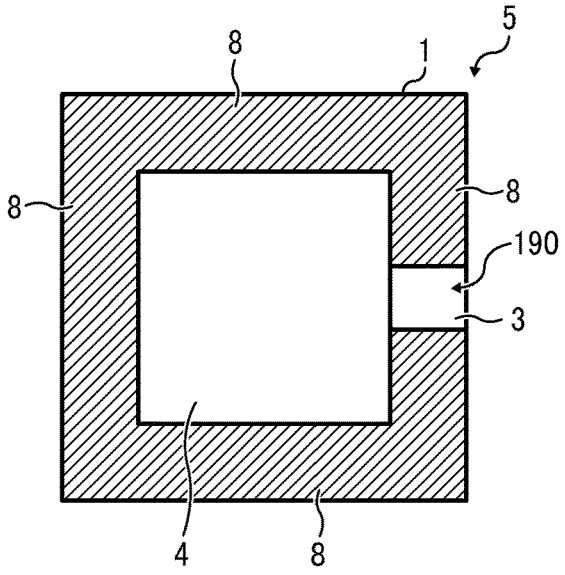

FIGS. 1A and 1B schematically illustrate the acoustic device 5, in which FIG. 1A is a side cross-sectional view of the acoustic device 5 and FIG. 1B is a cross-sectional view of the acoustic device along A-A line of FIG. 1A. The acoustic device 5, as illustrated in FIGS. 1A and 1B, includes a cavity forming member 1 and a cover member 2 that are joined together to thereby form a cavity 4 of the Helmholtz resonator. The cavity 4 is a sealed space and communicates to outside via the port 3.

The cavity forming member 1 is formed of resin materials such as polycarbonate and ABS resin, and the cover member 2 is a metal plate formed of metal materials such as zinc-coated steel plate and aluminum plate, but is not limited only to these materials. For example, resin material may be used for the cover member 2. The cavity forming member 1 is constructed of a bottom plate 7 disposed parallel to the plate-shaped cover member 2, and a side wall 8 extending vertically from the bottom plate 7. An edge face 19 of the side wall of the cavity forming member 1 at a side opposite the bottom plate 7 is joined to an opposite face 23 of the cover member 2 via fastening screws 9 (see FIGS. 5A and 5B), so that the cavity forming member 1 and the cover member 2 are joined together, thereby forming the acoustic device 5.

Because fastening is performed with the fastening screws 9, the cavity forming member 1 and the cover member 2 are joined together using a low-cost structure. In addition, due to the pressure caused by the screw-fastening, the cavity forming member 1 elastically deforms, so that the cavity forming member 1 deforms along the surface of the cover member 2 at the joint portion between the both members, to thereby prevent a gap from generating at the joint portion. Accordingly, reduction in the acoustic effect caused by the gap generating at the joint portion between the members to form the cavity 4 may be prevented using a low-cost structure.

Figure 5A:
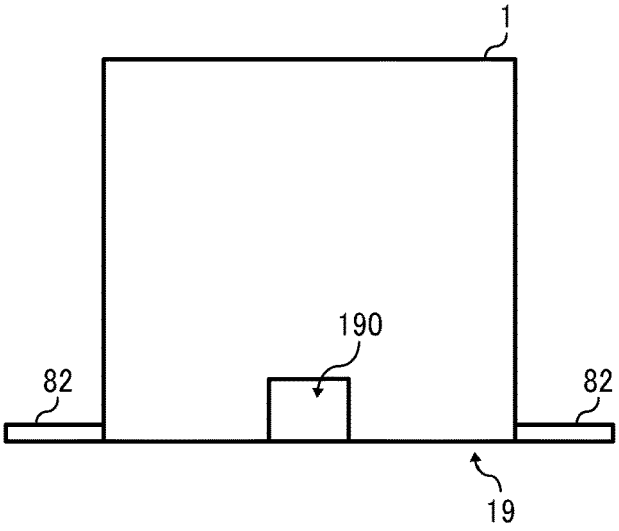
Figure 5B:
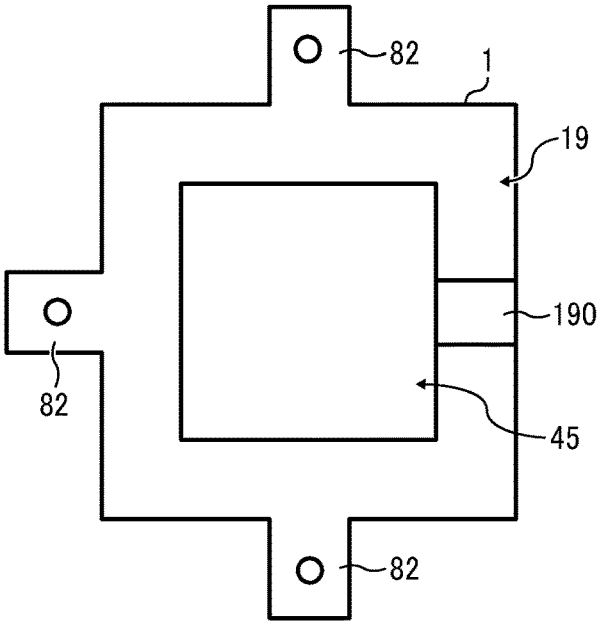

FIGS. 5A and 5B each illustrate the cavity forming member 1 to form the acoustic device according to the present embodiment, in which FIG. 5A is a side view viewed from the right in FIG. 1A and FIG. 5B is a bottom view of the cavity forming member 1 viewed from the bottom in FIG. 1A.

As illustrated in FIG. 5, the cavity forming member 1 includes a cutout portion 190 as a concave portion that does not contact the opposite face 23 of the cover member 2 when joined with the edge face 19 of the cavity forming member 1 as a joint face with the cover member 2. With this structure, due to a gap between the opposite face 23 of the cover member opposing to the cutout portion 190 and the cutout portion 190, a port 3 is formed at a joint portion between the cavity forming member 1 and the cover member 2.

As illustrated in FIGS. 5A and 5B, the cavity forming member 1 does not include an overlapped portion in a vertical direction of FIG. 5A and a direction perpendicular to a drawing sheet surface of FIG. 5B. As a result, when the cavity forming member 1 is formed by projection molding, the cavity forming member 1 as illustrated in each of FIGS. 5A and 5B can be formed with a pair of metal molds alone separable in the vertical direction of the cavity forming member 1 as illustrated in FIG. 5A. In this case, if a projection is formed to a part of the metal mold that forms the edge face 19 opposed to the bottom face of the cavity forming member 1 as illustrated in FIG. 5A, the cutout portion 190 is formed at the same time when the cavity forming member 1 is molded by projection molding. Specifically, the cavity forming member 1 can be formed including the cutout portion 190 as a shape of the port 3 by projection molding.

Because the cavity forming member 1 and the cutout portion 190 are formed at the same time by the projection molding to form an external shape of the cavity forming member 1, no hole making process to form the port 3 in the cavity forming member 1 is necessary. Further, because the port 3 is formed by a gap between the cutout portion 190 and the opposite face 23 of the cover member 2 at the joint portion, no hole making process for the cover member 2 is necessary. Thus, in the acoustic device 5 according to the present embodiment, no hole making process to form the port 3 relative to the member to form the acoustic device is necessary, thereby preventing an increase in the number of manufacturing processes.

Figure 16:
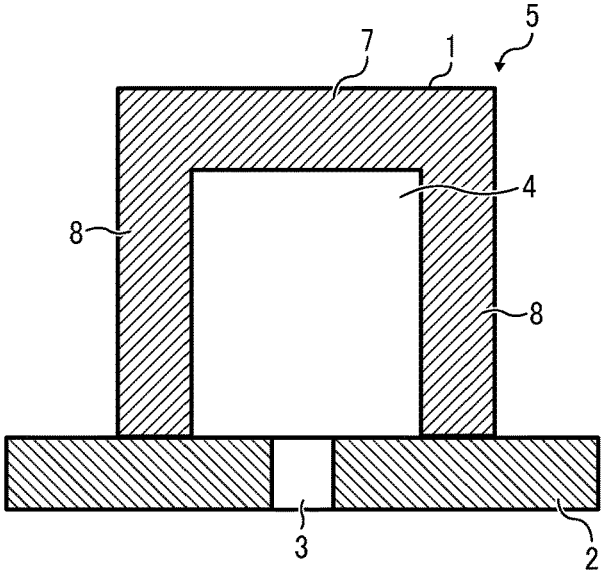
FIG. 16 CONVENTIONAL ART
FIG. 16 is a schematic cross-sectional view of a conventional acoustic device.

To provide a fuller appreciation of the advantages of acoustic device of the present disclosure, FIG. 16 is a schematic cross-sectional view of a conventional acoustic device 5. The acoustic device illustrated in FIG. 16 also employs the Helmholtz resonator that forms the cavity 4 by joining the cavity forming member 1 and the cover member 2. However, the acoustic device 5 of FIG. 16 makes a hole to form the port 3 relative to the plate-shaped cover member 2, and therefore, is different from the acoustic device 5 according to the present embodiment illustrated in FIG. 1.

There is a case in which the acoustic device is formed such that the cavity forming member 1 is joined to a larger plate-shaped member such as an inner cover or a side plate of the body of the image forming apparatus. In this case, the plate-shaped member is concurrently used as the cover member 2. As a result, any dedicated part is not necessary for the cover member 2 and the number of parts can be reduced.

When the cover member 2 of the acoustic device 5 illustrated in FIG. 16 is the large plate-shaped member as described above, a hole is previously made on the plate-shaped member which will be the cover member 2, and the cover member 2 is joined with the cavity forming member 1 to thereby form the acoustic device 5. In the thus-formed acoustic device 5, a sound on the side opposite the cavity forming member 1 with the plate-shaped member that is concurrently used as the cover member 2 interposed can be effectively absorbed, but a sound on the same side as the cavity forming member 1 with the plate-shaped member interposed cannot be absorbed effectively.

On the other hand, when the cover member 2 of the acoustic device 5 according to the present embodiment illustrated in FIGS. 1A and 1B is the above-described large plate-shaped member, the acoustic device 5 is formed such that a shape to form the port 3 is disposed on the cavity forming member 1, and the plate-shaped member is joined with the cavity forming member 1. In this acoustic device 5, a sound on the side opposite the cavity forming member 1 with the plate-shaped member that is concurrently used as the cover member 2 interposed, is blocked by the plate-shaped member and cannot be effectively absorbed, but a sound on the same side as the cavity forming member 1 with the plate-shaped member interposed can be absorbed effectively.

As an exemplary configuration of the acoustic device, there is a case in which ample space is available to provide the cavity forming member 1 inside the plate-shaped member. When the cavity forming member 1 is disposed outside the plate-shaped member, the size of the acoustic device 5 will be larger. To prevent this, it is preferable that the cavity forming member 1 be disposed inside the plate-shaped member. However, in the event that the plate-shaped member is concurrently used as the cover member 2 and the acoustic device 5 illustrated in FIG. 16 is used. the port 3 is open toward an outside of the plate-shaped member, and the sound from the sound source generated inside the plate-shaped member cannot be effectively absorbed. On the other hand, when the acoustic device 5 illustrated in FIGS. 1A and 1B is used, the port 3 is open toward an inside of the plate-shaped member, and the sound from the sound source generated inside the plate-shaped member can be effectively absorbed.

Further, when the plate-shaped member is concurrently used as the cover member 2, the acoustic device 5 illustrated in FIG. 16 necessitates that a hole serving as the port 3 is previously provided for the plate-shaped member as a relatively large member. It can be thought that the plate-shaped member, with a hole, made of resin materials is formed by projection molding. However, when the cross-sectional area of the port is changed to change the frequency of the sound to be absorbed due to specification change and the like, a relatively large metal mold is to be rebuilt to form the relatively large plate-shaped member, which may increase a manufacturing cost. In either case in which the material of the plate-shaped member is a resin or metal, it can be though that the hole making process is applied after the plate shape has been prepared, which may increase the number of processes for hole making.

By contrast, the acoustic device 5 according to the present embodiment illustrated in FIGS. 1A and 1B, a shape to form the port 3 is provided to the cavity forming member 1, thereby making it unnecessary to make a hole serving as the port 3 for the plate-shaped member. When the cavity forming member 1 is formed of resin materials, a shape to form the port 3 is disposed to the metal mold for projection molding, thereby preventing the number of processes from increasing. When the cross-sectional area of the port 3 is to be changed due to specification change and the like, a relatively small metal mold can be rebuilt to form a relatively small cavity forming member 1 for the plate-shaped member, thereby preventing the manufacturing cost from increasing.

The acoustic device 5 illustrated in FIGS. 1A and 1B is configured such that the cutout portion 190 as a shape to form the port 3 is provided on a part at an edge of the side wall 8 of the cavity forming member 1, and the cover member 2 is joined, thereby forming the port 3 at the joint portion. In the structure illustrated in FIGS. 1A and 1B, part of the face extending in the opening direction, that is, a horizontal direction in the figure, of the port 3 is formed by the planar opposite face 23 of the plate-shaped cover member 2. With such a structure, the cover member 2 forming the opposite face 23 of the cover member does not need any additional process to form the port 3, and the cover member 3 including a planar face can be used as is.

In the acoustic device 5 illustrated in FIGS. 1A and 1B, the cavity forming member 1 includes the bottom plate 7 disposed opposite the cover member 2 with the cavity 4 disposed in between, and the side wall 8 extending from the bottom plate 7 to the cover member 2. The edge face 19 of the cavity forming member as the edge face on the side opposite the bottom plate 7 of the side wall 8 contacts the opposite face 23 of the cover member as the planar face of the cover member 2, thereby forming the cavity 4. Further, the opposite face 23 of the cover member includes a projected portion 230 of the opposite face 23. The projected portion 230 projects toward outside the side wall 8 at the joint portion where the port 3 is formed.

Part of the sound incident to the projected portion 230 of the opposite face 23 is reflected and incident on an outer face of the side wall 8 vertically extending from the projected portion 230. With this structure, because the port 3 is disposed on the side wall 8 to which the reflected sound is incident, the sound can be effectively absorbed.

The port 3 of the acoustic device 5 illustrated in FIGS. 1A and 1B is disposed on the same planar face as that of the projected portion 230 of the opposite face 23 of the cover member 2, so that the sound reflected to the projected portion 230 can be received inside the port 3 before diffusion. Further, the sound emitted along the projected portion 230 can be received inside the port 3. With this structure, the sound reflected to the projected portion 230 and the sound transmitted along the projected portion 230 can be effectively absorbed.

In addition, the cover member 2 to form the projected portion 230 is made of metal materials having a density greater than that of the resin materials. As a result, the incident sound rarely penetrates the projected portion 230 than the cavity forming member 1 made of resin materials, and tends to be a reflected sound. Thus, because the sound reflected by the projected portion 230 of the opposite face 23 that tends to reflect sound, and the sound transmitted along the projected portion 230 can be received inside the port 3, the sound can be effectively absorbed. Further, the shape of the position of the port 3 can be variably changed with the resin molded part, and a plural number of hole making processes as performed in burring are not required, thereby reducing the number of manufacturing processes.

Figure 14:
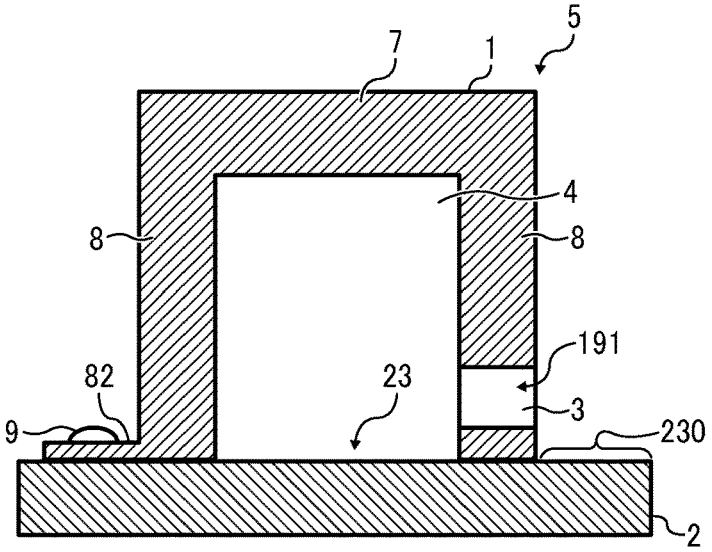
FIG. 14 is a schematic cross-sectional view of an acoustic device according to a first modification.

FIG. 14 schematically illustrates an acoustic device 5 according to a first modification. The acoustic device 5 according to the first modification is different from the acoustic device 5 illustrated in FIGS. 1A and 1B in that a hole 191 that passes through the side wall 8 of the cavity forming member 1 is provided. The acoustic device 5 of the first modification is different in the position of the port 3, and otherwise, constructed similarly to the acoustic device 5 illustrated in FIGS. 1A and 1B. As a result, part of the sound incident to the projected portion 230 of the opposite face 23 is reflected and incident to the outer face of the side wall 8 extending vertically from the projected portion 230. Thus, the port 3 is disposed on the side wall 8 to which the sound reflected by the projected portion 230 is incident, and the sound can be effectively absorbed.

In addition, the port 3 of the acoustic device 5 according to the first modification is disposed at a position nearer to the projected portion 230 positioned at a lower portion than the center of the side wall 8 in the vertical direction in FIG. 14. As a result, the sound reflected by the projected portion 230 can be received inside the port 3 before diffusion. Further, the sound transmitted along the projected portion 230 can be effectively absorbed.

In addition, the cover member 2 that forms the projected portion 230 is made of metal materials having a density greater than that of the resin materials. As a result, the incident sound rarely penetrates the projected portion 230 than the cavity forming member 1 made of resin materials, and tends to be a reflected sound. Thus, because the sound reflected by the projected portion 230 that tends to reflect the sound and the sound transmitted along the projected portion 230 can be received inside the port 3, the sound can be effectively absorbed.

Figure 15:
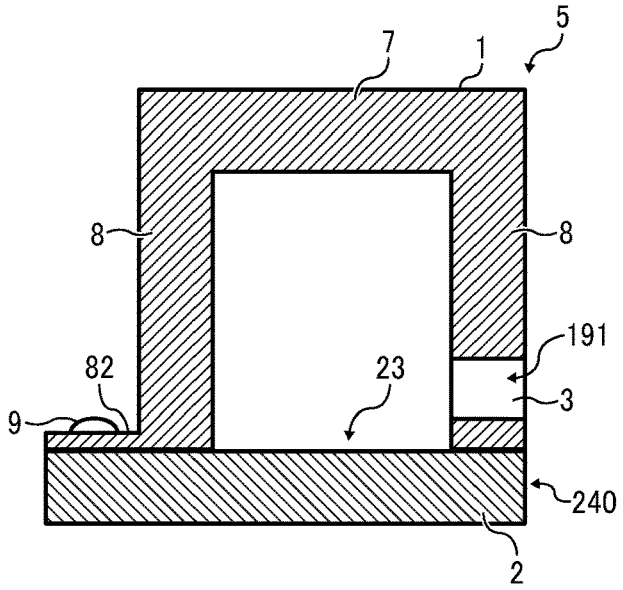
FIG. 15 is a schematic cross-sectional view of an acoustic device according to a second modification.

FIG. 15 schematically illustrates an acoustic device 5 according to a second modification. The acoustic device 5 according to the second modification is different from the acoustic device 5 illustrated in FIG. 14 in that the cover member 2 does not include a part forming the projected portion 230. The acoustic device 5 of the second modification includes the cover member 2 made of metal materials having a density greater than that of resin materials, the incident sound rarely penetrates the cover member 2, and the sound tends to be a reflected sound than the cavity forming member 1 made of resin materials. As a result, a sound incident to an edge portion 240 of the cover member 2 of FIG. 15 tends to be a reflected sound than the sound incident to the surface of the side wall 8 of the cavity forming member 1 disposed substantially on the same plane as the edge portion 240.

The acoustic device 5 of the second modification includes the port 3 disposed on the side wall 8 positioned on the substantially same plane as the edge portion 240 at which the incident sound tends to be a reflected sound. As a result, the sound reflected by the edge portion 240 and the sound transmitted along the surface of the edge portion 240 and the side wall 8 can be effectively absorbed.

In addition, the port 3 of the acoustic device 5 according to the second modification is disposed at a position nearer to the edge portion 240 positioned at a lower portion than the center of the side wall 8 in the vertical direction in FIG. 15. As a result, the sound reflected by the edge portion 240 can be received inside the port 3 before diffusion. With this structure, the sound reflected by the edge portion 240 and the sound emitted along the projected portion 230 can be effectively absorbed.

When each of the cavity forming members 1 of the acoustic devices 5 illustrated in FIGS. 14 and 15 are formed by projection molding, the hole 191 to form the port 3 cannot be formed with the vertically separable metal molds alone of the cavity forming member 1 in FIGS. 14 and 15. Thus, when forming the cavity forming member 1 of the acoustic device 5 as depicted in FIGS. 14 and 15, an additional metal mold to form the hole is required.

On the other hand, in the acoustic device 5 in FIGS. 1A and 1B, the cutout portion forming the port 3 has a concave shape in the vertical direction in FIG. 1A (i.e., the direction perpendicular to the sheet surface in FIG. 1B) relative to the edge portion of the side wall. As a result, when forming the cavity forming member of the acoustic device 5 illustrated in FIGS. 1A and 1B by projection molding, the cavity forming member 1 including the shape to form the port 3 can be formed with the vertically separable metal molds alone of the cavity forming member 1 in FIGS. 1A and 1B.

Figure 6A:
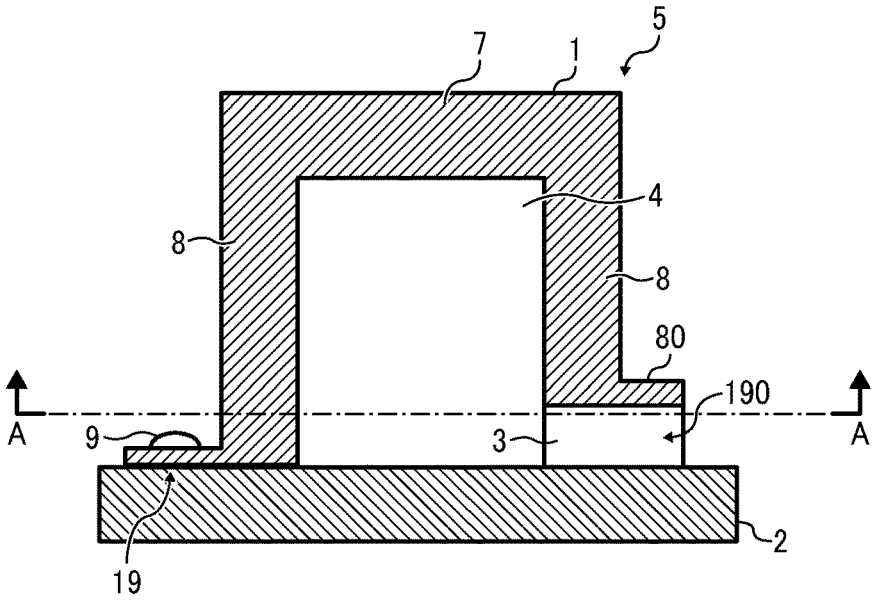
Figure 6B:
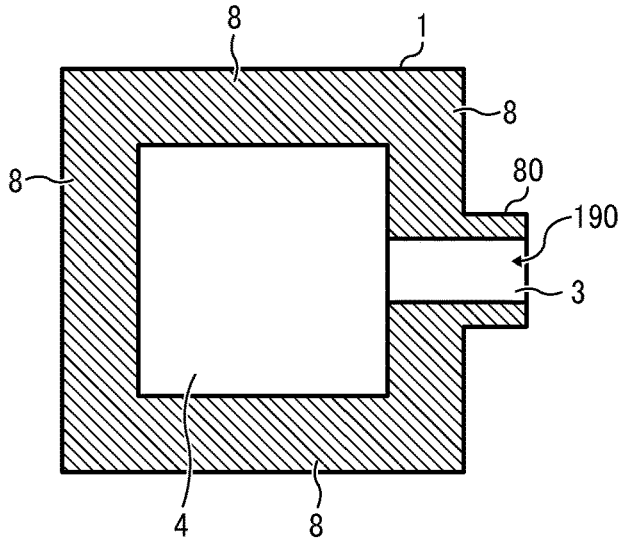

FIGS. 6A and 6B illustrate a modification of the structure of an acoustic device 5 in which FIG. 6A is a cross-sectional side view and FIG. 6B is a cross-sectional view along A-A line of FIG. 6A. The acoustic device 5 illustrated in FIGS. 6A and 6B includes a flange 80 added to the port 3 of the cavity forming member 1 of the acoustic device 5 illustrated in FIGS. 1A and 1B. As illustrated in FIG. 6A, the flange 80 is disposed in the acoustic device 5 according to the second structure. Therefore, the length of the port (that is, "H" in FIG. 4) is longer than the acoustic device 5 illustrated in FIGS. 1A and 1B, and the frequency of the sound as the absorption target can be set at a lower frequency according to the above formula (1).

In addition, in the cavity forming member 1 of the acoustic device 5 illustrated in FIGS. 6A and 6B, the flange 80 has a shape protruding toward outward. When viewed from a lower part as illustrated in FIG. 6B, the flange 8 does not overlap with other part of the cavity forming member 1. Thus, the cavity forming member 1 of the acoustic device 5 illustrated in FIGS. 6A and 6B including the shape forming the port 3 can be formed with the metal molds alone separable in the vertical direction of the cavity forming member 1 illustrated in FIG. 6A, similarly to the cavity forming member 1 of the acoustic device 5 illustrated in FIGS. 1A and 1B.

Figure 7:
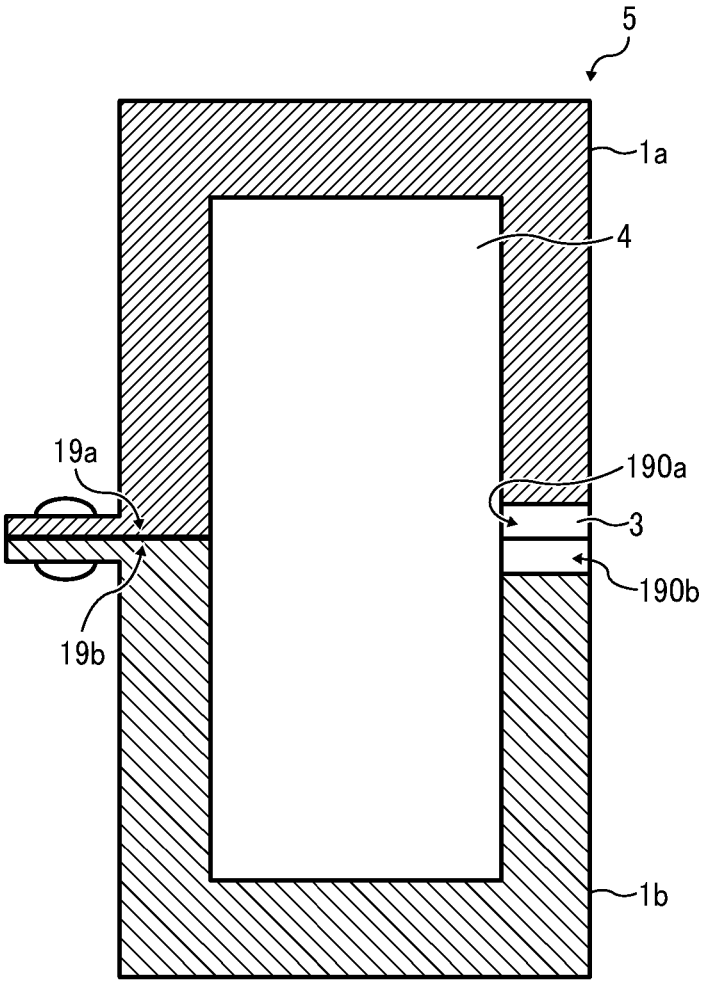
FIG. 7 schematically illustrates an acoustic device according to a third structure.

FIG. 7 schematically illustrates a third modification of the structure the structure of an acoustic device 5 The acoustic device 5 illustrated in FIG. 7 includes a first cavity forming member 1*a* and a second cavity forming member 1*b* that are joined together by screws 9, to thereby form the cavity 4 of the Helmholtz resonator. The first cavity forming member 1*a* includes a joint portion 19*a* and the second cavity forming member 1*b* includes a joint portion 19*b*. The joint portion 19*a* and the joint portion 19*b* are joined together. Each of the first and second cavity forming members 1*a* and 1*b* includes a cutout 190*a* and a cutout 190*b* at an end of the joint portion, and two cutouts are opposed each other, to thereby form one port 3. When the first cavity forming member 1*a* and the second cavity forming member 1*b* are formed by injection molding, the cavity forming member 1 including the shape forming the port 3 can be formed by the metal molds alone separable in the vertical direction of each member in FIG. 7.

First Embodiment

Figure 8A:
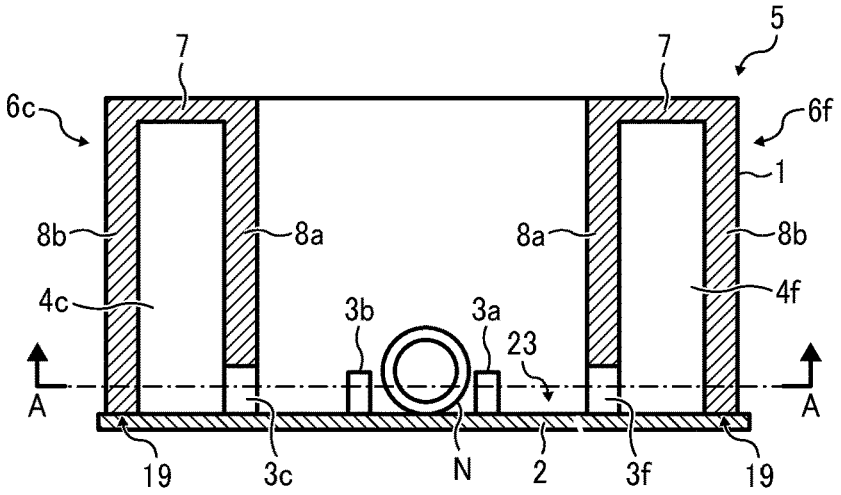
Figure 8B:
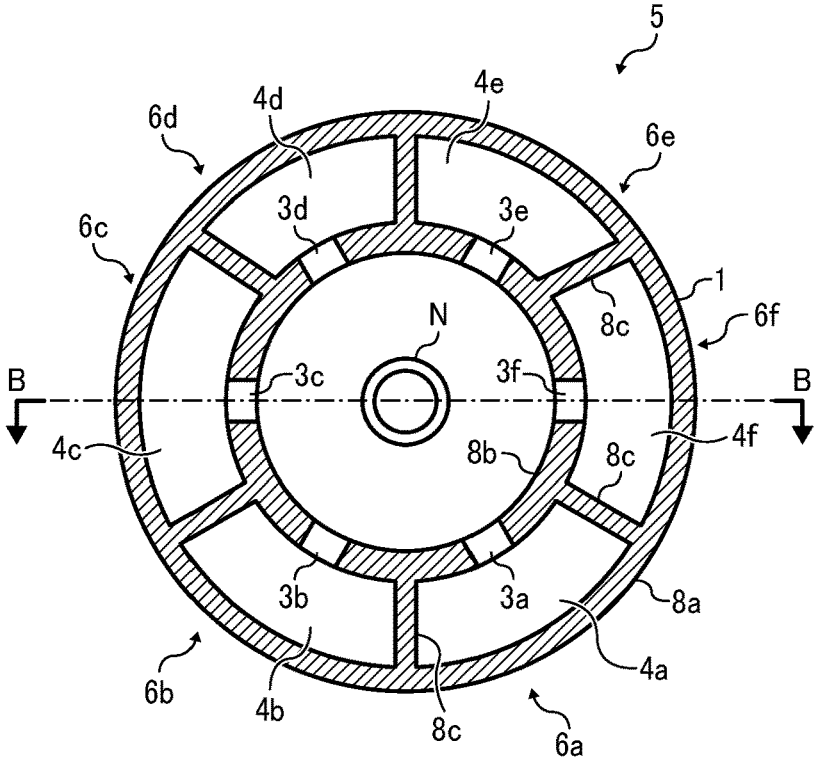

Next, an acoustic device 5 according to a first embodiment of the present invention is described with reference to FIGS. 8A and 8B, in which FIG. 8A is a side cross-sectional view and FIG. 8B is a cross-sectional view along A-A line of FIG. 8A. Further, FIG. 8A is a cross-sectional view along B-B line of FIG. 8B. The acoustic device 5 according to the first embodiment includes a cavity forming member 1 formed of resin materials and a cover member 2 formed of a metal plate.

The acoustic device 5 according to the first embodiment includes six Helmholtz resonators 6 (from a first to sixth resonators 6*a*, 6*b*, 6*c*, 6*d*, 6*e*, and 6*f*) each including a set of a cavity forming member 1 and a cover member 2. As illustrated in FIG. 8, the acoustic device 5 according to the first embodiment includes six Helmholtz resonators 6 disposed circularly to surround a sound source mount position N. The sound source mount position N is a position where the sound source such as a drive motor generating an absorption target sound is disposed when the acoustic device 5 is mounted to the copier 500.

A cavity forming member 1 includes a shape to form a cavity 4 (4*a* to 4*f*) and a port 3 (3*a* to 3*f*) of the Helmholtz resonator 6 (6*a* to 6*f*). The cavity forming member 1 includes partly the shape for accommodating the cavity 4 (4*a* to 4*f*) and the port 3 (3*a* to 3*f*), but does not include a whole structure. When the joint portion between the cavity forming member 1 and the planar plate-shaped cover member 2 is closely sealed, the Helmholtz resonator 6 (6*a* to 6*f*) including the cavity 4 (4*a* to 4*f*) and the port 3 (3*a* to 3*f*) can be formed.

The cavity forming member 1 according to the first embodiment includes a bottom plate 7 parallel to the cover member 2, and a side wall 8 extending from the bottom plate 7 to the cover member 2. The side wall 8 includes an inner side wall 8*a*, an outer side wall 8*b*, and a partition side wall 8*c*. The inner side wall 8*a* and the outer side wall 8*b* in the cavity forming member 1 are circularly disposed, to thereby surround an entire periphery of the sound source mount position N.

As illustrated in FIG. 8, the acoustic device 5 is configured such that six acoustic devices 5 are circularly disposed. The plurality of circularly-disposed acoustic devices 5 illustrated in FIGS. 1A and 1B may employ a structure as illustrated in FIGS. 6A and 6B or FIG. 7, without being limited to the acoustic device 5 illustrated in FIGS. 1A and 1B. In addition, the cover member 2 extends toward an inner side than the inner side wall 8*a* and covers a lower portion of the sound source mount position N in FIG. 8A. The surface of part of the cover member 2 extending toward the inner side than the inner side wall 8*a* opposite the sound source mount position N exerts the same effect as that of the above-described projected portion 230 of the cover member 2, the sound can be effectively absorbed than the structure that fails to include the extending portion.

COMPARATIVE EXAMPLE

Figure 17A:
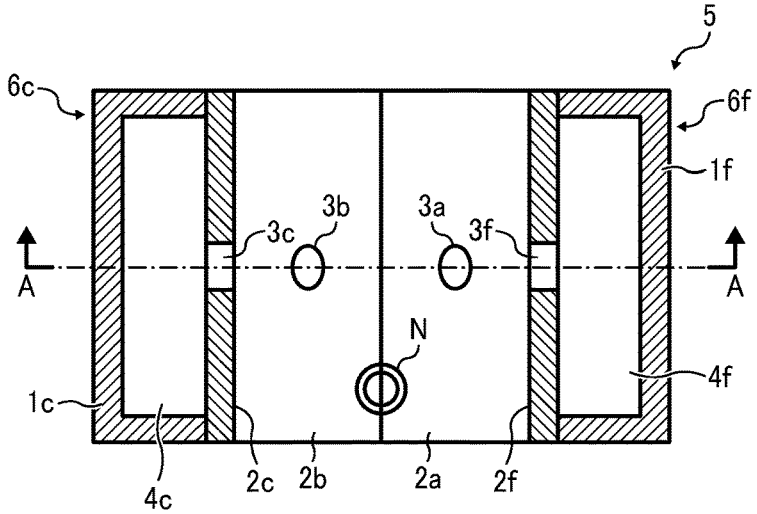
Figure 17B:
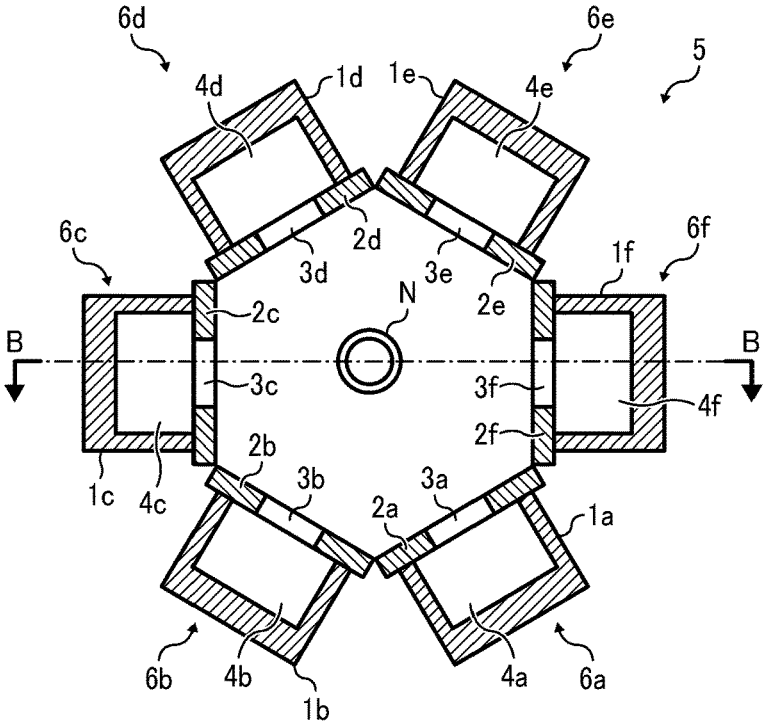

Next, a comparative example of the acoustic device 5 including a plurality of Helmholtz resonators disposed circularly is described. FIGS. 17A and 17B illustrate an acoustic device 5 according to the comparative example, in which FIG. 17A is a side cross-sectional view of the acoustic device 5, and FIG. 17B is a cross-sectional view thereof along A-A line of FIG. 17B. Further, the acoustic device 5 according to the comparative example illustrated in FIGS. 17A and 17B has a structure in which six pieces of the conventional acoustic device 5 illustrated in FIG. 16 are circularly disposed.

The acoustic device 5 illustrated in FIGS. 17A and 17B includes six Helmholtz resonators 6 (from a first to sixth resonators 6*a*, 6*b*, 6*c*, 6*d*, 6*e*, and 6*f*) each including a set of a cavity forming member 1 (1*a* to 1*f*) and a cover member 2 (2*a* to 2*f*). As illustrated in FIG. 17B, the acoustic device 5 according to the comparative example includes six Helmholtz resonators 6 disposed circularly to surround a sound source mount position N.

When the plurality of Helmholtz resonators 6 are disposed around the sound source mount position N using the structure of the conventional acoustic device 5 illustrated in FIG. 16, and the port 3 of the Helmholtz resonator 6 is oriented to the sound source mount position N, the acoustic device 5 according to the comparative example illustrated in FIGS. 17A and 17B is formed. In the acoustic device 5, because the port 3 is disposed on the cover member 2, the cover member 2 needs to surround the sound source mount position N to direct the port 3 to the sound source mount position N.

When the cover member 2 is formed of the metal plate, first, a hole to form the port 3 is bored in the metal plate and the metal plate is subjected to a circular bending process to surround the sound source mount position N for the one metal plate to surround the sound source mount position N. Further, to fill the gap between edges of the circularly bent metal plate, joint process by welding will be necessary. Thus, very complicated processes need to be performed and it is very difficult for the cover member 2 formed of one plate to surround the sound source mount position N. Accordingly, as illustrated in FIGS. 17A and 17B, the cover member 2 corresponding to each Helmholtz resonator 6 is disposed.

When each cover member 2 is formed of resin materials, an open direction of each port 3 is different from each other. As a result, the cover member 2 with all the ports 3 of the Helmholtz resonators 6 cannot be formed by casting.

In addition, in the cavity forming member 1 of the acoustic device 5 according to the comparative example, when the open port of the cavity 4 to be covered by the cover member 2 is oriented to the sound source mount position N, the opening direction of the cavity forming member 1 is different from each other. As a result, when the cavity forming member 1 is formed of resin materials, the cavity forming member 1 to form the cavity 4 for all the Helmholtz resonators 6 cannot be formed by casting.

Thus, both the cavity forming member 1 and the cover member 2 cannot be formed by casting. Accordingly, as illustrated in FIGS. 17A and 17B, the number of parts becomes large because six sets of cavity forming members 1 and cover members 2 corresponding to six Helmholtz resonators 6 are necessary.

On the other hand, the acoustic device 5 according to the first embodiment as illustrated in FIGS. 8A and 8B includes a cover member 2 formed of one piece of planar metal plate parallel to a cross section as illustrated in FIG. 8B, that forms a part of all the Helmholtz resonators 6 (6*a* to 6*f*). In addition, the cavity forming member 1 of the acoustic device 5 according to the first embodiment includes a bottom plate 7 and a side wall 8 vertically extending from the bottom plate 7 alone, and cutout portions to form ports 3 are disposed at ends of the side wall 8 on a side opposite the bottom plate 7. With this structure, as illustrated in FIGS. 8A and 8B, the cavity forming member 1 of the acoustic device 5 according to the first embodiment does not include an overlapped portion in the vertical direction in FIG. 8A and in a direction perpendicular to the surface of the drawing sheet in FIG. 8B. As a result, when the cavity forming member 1 is formed by projection molding, the cavity forming member 1 including a shape to form the port 3 can be formed with a pair of vertically separable metal molds for the cavity forming member 1 in FIG. 8A.

Thus, the acoustic device 5 according to the first embodiment is constructed such that the shape forming the plurality of cavities 4 (4*a* to 4*f*) is formed of the cavity forming member 1 molded by casting, and the cover member 2 formed of one piece of metal plate. As a result, a structure in which a plurality of Helmholtz resonators 6 is circularly disposed to surround the sound source mount position N, to thereby improve sound absorbing efficiency, can be embodied with a minimum number of parts such as two pieces alone.

The acoustic device employing a Helmholtz resonator exerts effects to the sound incident to the acoustic device. Accordingly, as a structure to improve the sound absorbing effects, it can be considered that the Helmholtz resonators are so disposed as to surround the sound source as illustrated in FIGS. 8A and 8B and FIGS. 17A and 17B. However, an approach to realize a structure to surround the sound source with conventional acoustic devices, four or more Helmholtz resonators 6 (six in the example illustrated in FIGS. 17A and 17B) each including the cavity forming member 1 and the cover member 2 are required to be joined together to surround planar four directions. Each Helmholtz resonator 6 includes at least two parts, and therefore, eight or more parts (and twelve in the example illustrated in FIGS. 17A and 17B) are required to surround the sound source.

In addition, to improve the acoustic effects with the structure illustrated in FIGS. 17A and 17B, fastening and sealing devices are needed to prevent leaks of the sound from joint portions between the plurality of Helmholtz resonators 6, leading to an increase of costs and processes in manufacturing.

On the other hand, the acoustic device 5 according to the first embodiment illustrated in FIGS. 8A and 8B includes one part formed of the cavity forming member 1 as a resin part including the cavity 4 and the port 3 and the other part form of the cover member 2 as a metal part including the cavity 4 and the port 3, and the cavity forming member 1 and the cover member 2 are joined together, so that the structure to dispose the Helmholtz resonators around all the periphery of the sound source mount position N is realized. Thus, the acoustic device 5 according to the first embodiment illustrated in FIGS. 8A and 8B is configured to surround all the periphery of the sound source mount position N with the resin-made cavity forming member 1 prepared by casting, and the cost-effective and efficient acoustic device 5 can be realized.

In the structure in which the plurality of Helmholtz resonators 6 are disposed as in the acoustic device 5 according to the first embodiment, volumes of the plurality of cavities 4, and cross-sectional areas and heights of the plurality of ports 3 can be varied, so that the frequency of the sound to be absorbed by each of the Helmholtz resonators 6 can be varied. With this structure, even though the sound emitted from the sound source disposed at the sound source mount position N includes various frequencies, the sound can be absorbed by the acoustic device 5.

Second Embodiment

Figure 9A:
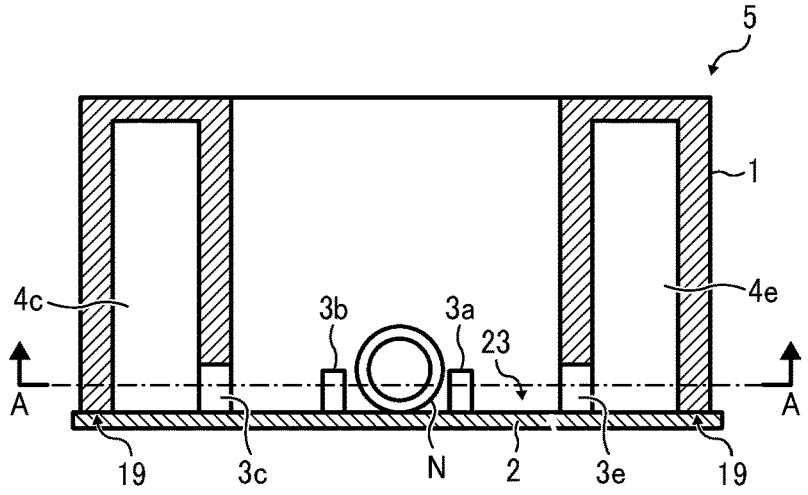
Figure 9B:
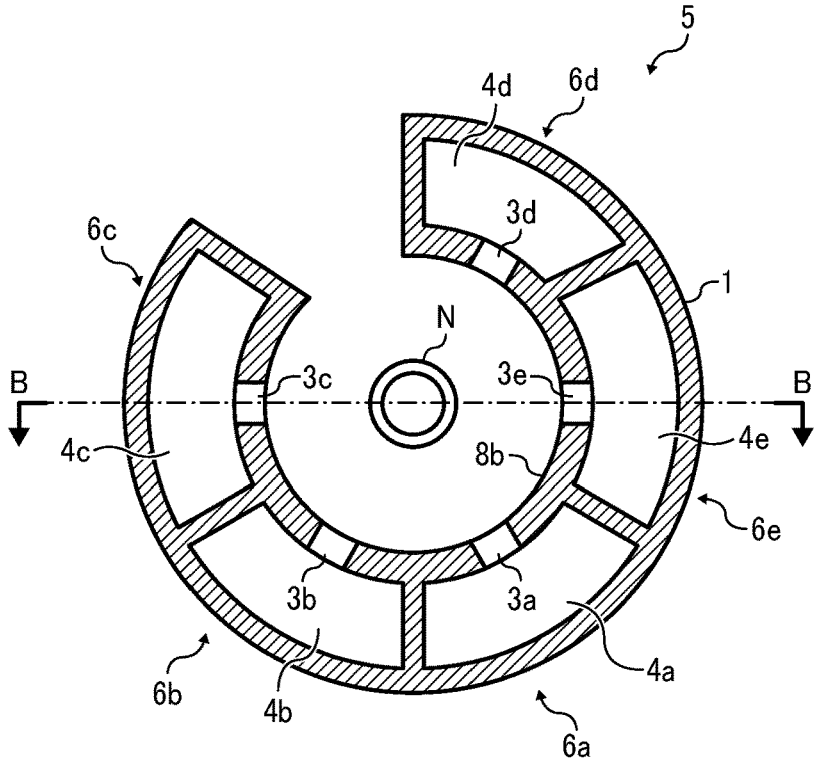

Next, an acoustic device 5 according to a second embodiment is described. FIGS. 9A and 9B illustrate the acoustic device 5 according to the second embodiment, in which FIG. 9A is a side cross-sectional view of the acoustic device 5 and FIG. 9B is a cross-sectional view along A-A cross-section of FIG. 9A. In addition, FIG. 9A is a cross-sectional view along B-B cross-section of FIG. 9B. The acoustic device 5 according to the second embodiment illustrated in FIGS. 9A and 9B is different in that the number of the Helmholtz resonators 6 is five which is less than that of the same by one compared to the acoustic device according to the first embodiment, and that a part in the peripheral direction is open.

When the drive source is the sound source, such sound source may generate heat during operation. In this case, when all the periphery of the sound source mount position N is surrounded as in the acoustic device 5 according to the first embodiment illustrated in FIGS. 8A and 8B, the temperature of a space inside the acoustic device 5 increases, which may cause failure of the part or component of the sound source and deformation of the cavity forming member 1 formed of resin materials. However, due to the acoustic device 5 according to the second embodiment illustrated in FIGS. 9A and 9B in which a part in the peripheral direction is open, air inside and outside the acoustic device 5 can be interchanged, to thereby prevent the temperature inside the acoustic device 5 from rising. In addition, the acoustic device 5 according to the second embodiment illustrated in FIGS. 9A and 9B may afford a layout to prevent interference with the parts other than the acoustic device 5.

Third Embodiment

Figure 10A:
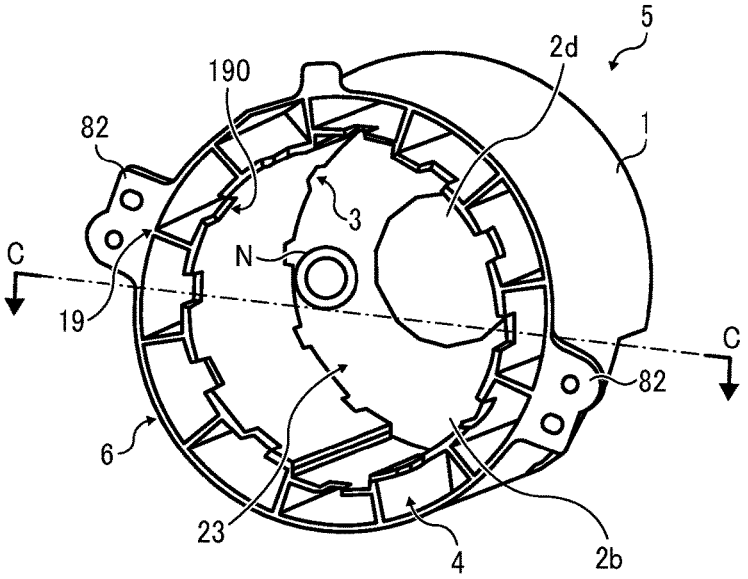
Figure 10B:
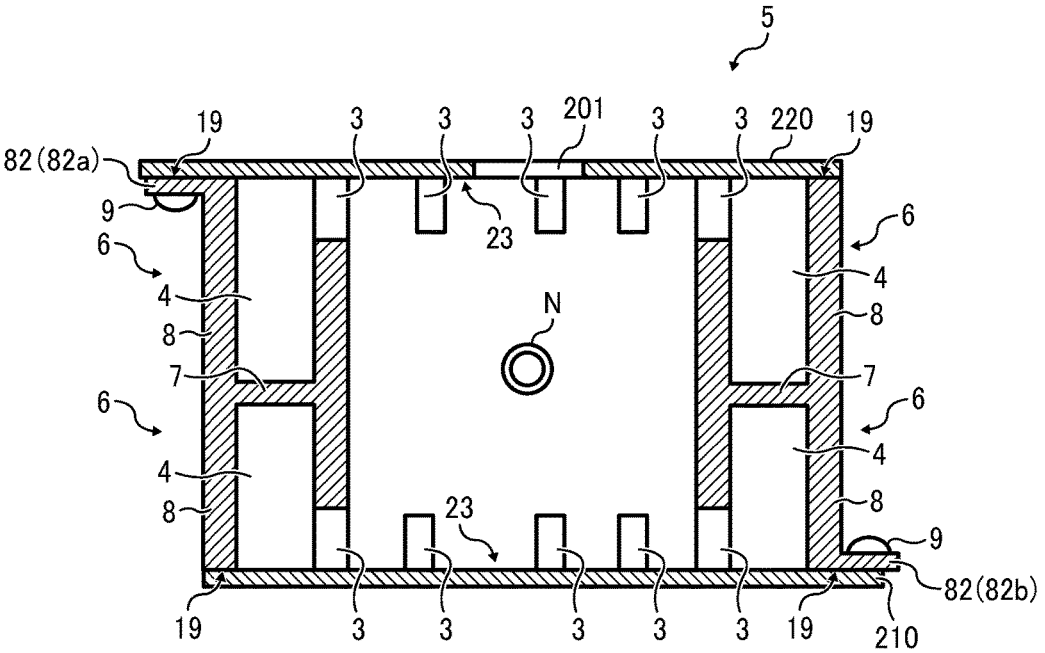

Next, an acoustic device 5 according to a third embodiment is described. FIGS. 10A and 10B illustrate the acoustic device 5 according to the third embodiment, in which FIG. 10A is a cross-sectional view of the acoustic device 5 from which a non-open cover member 210, to be described later, is removed, and FIG. 10B is a cross-sectional view along C-C cross-section in FIG. 10C. In addition, FIG. 10A is a perspective view of the acoustic device 5 viewed from a lower side.

The acoustic device 5 according to the third embodiment illustrated in FIGS. 10A and 10B includes twelve Helmholtz resonators 6 in the peripheral direction and in two-level structure vertically. The cavity forming member 1 of the acoustic device 5 illustrated in FIGS. 10A and 10B is configured such that the side wall 8 extends vertically upward and downward as in FIG. 10B from the bottom plate 7, and each cutout portion 190 as the port 3 is disposed at an opposite end of the bottom plate 7 in each of the side wall 8.

A non-open cover member 210 is joined at a lower end of the cavity forming member 1 as in FIG. 10B, twelve lower Helmholtz resonators 6 in FIG. 10B can be formed. In addition, an open cover member 220 is joined at an upper end of the cavity forming member 1 as in FIG. 10B, twelve upper Helmholtz resonators 6 can be formed. The cavity forming member 1, the non-open cover member 210, and the open cover member 220 are joined together by fastening with screws 9 a joint projection 82*a* and a joint projection 82*b* of the cavity forming member 1 with the non-open cover member 210 and the open cover member 220, respectively. With this structure, the acoustic device 5 according to the third embodiment including an opening 201 disposed above the sound source mount position N as illustrated in FIG. 10B can be formed.

Further, as illustrated in FIG. 10B, a position of the joint projection 82*a* joined to the non-open cover member 210 and a position of the joint projection 82*b* joined to the open cover member 220 are shifted in the peripheral direction. With this structure, the cavity forming member 1 of the acoustic device 5 according to the third embodiment illustrated in FIGS. 10A and 10B does not include any overlapped portion in the vertical direction in FIG. 10B an in the direction from the left front side to the right rear side in FIG. 10A. As a result, when the cavity forming member 1 that forms the upper and lower two-level Helmholtz resonators 6 is formed by projection molding, the cavity forming member 1 including the shape to form each port 3 can be formed with a pair of vertically separable metal molds alone.

In addition, in the acoustic device 5 illustrated in FIGS. 10A and 10B, a length of the cavity 4 disposed below in the FIG. 10B is shorter than that of the cavity 4 disposed above in the FIG. 10B with the bottom plate 7 interposed in between. With this structure, the frequency of the sound as absorption target sound for each Helmholtz resonator 6 including two cavities 4 disposed one above the other is varied.

Figure 11:
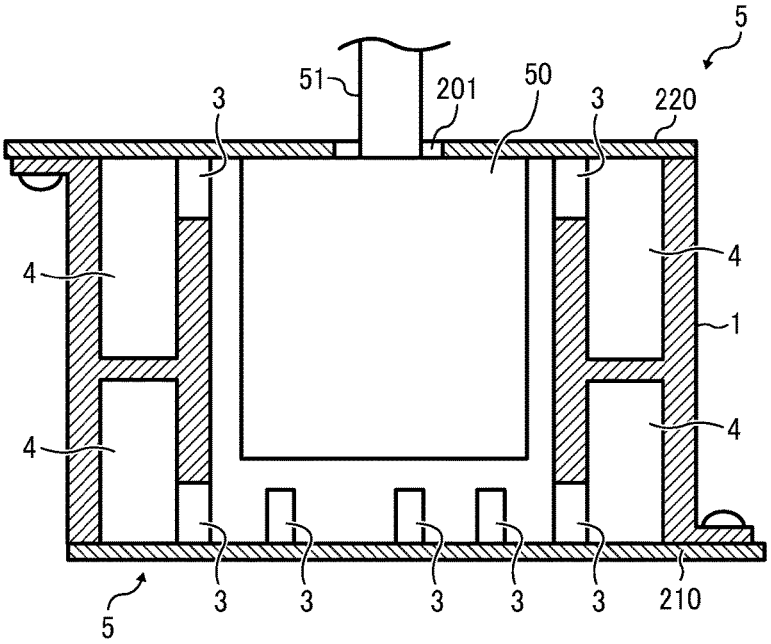
FIG. 11 illustrates the acoustic device in which a drive motor is disposed at a position of a sound source.

FIG. 11 illustrates the acoustic device 5 according to the third embodiment illustrated in FIGS. 10A and 10B, in which a drive motor 50 as a sound source is disposed at the sound source mount position N inside the acoustic device 5. A rotary shaft 51 of the drive motor 50 projects outside the acoustic device 5 from the opening 201 of the open cover member 220, so that a drive of the drive motor 50 disposed inside the acoustic device 5 can be transmitted outside the acoustic device 5.

Examples of the drive motor 50 include a roller drive motor to input a drive to a drive roller and a polygon motor 49, but are not limited thereto. In addition, a sound source disposed inside the acoustic device 5 so as to surround the periphery of the sound source mount position N is not limited to the drive motor 50. For example, a drive transmitter of planet gears can be an example.

In the structure as depicted in FIG. 11, the rotary shaft 51 of the drive motor 50 positions at the sound source mount position N. With this structure, friction sound generated due to friction with other parts when the rotary shaft 51 rotates can be effectively absorbed.

Fourth Embodiment

Figure 12A:
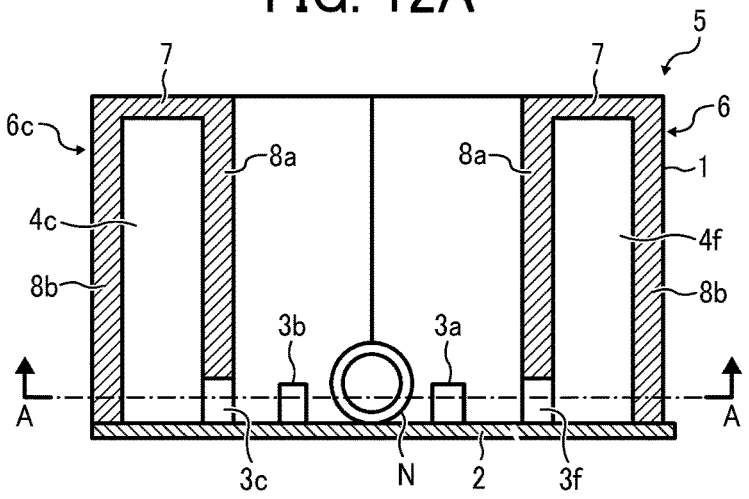
Figure 12B:
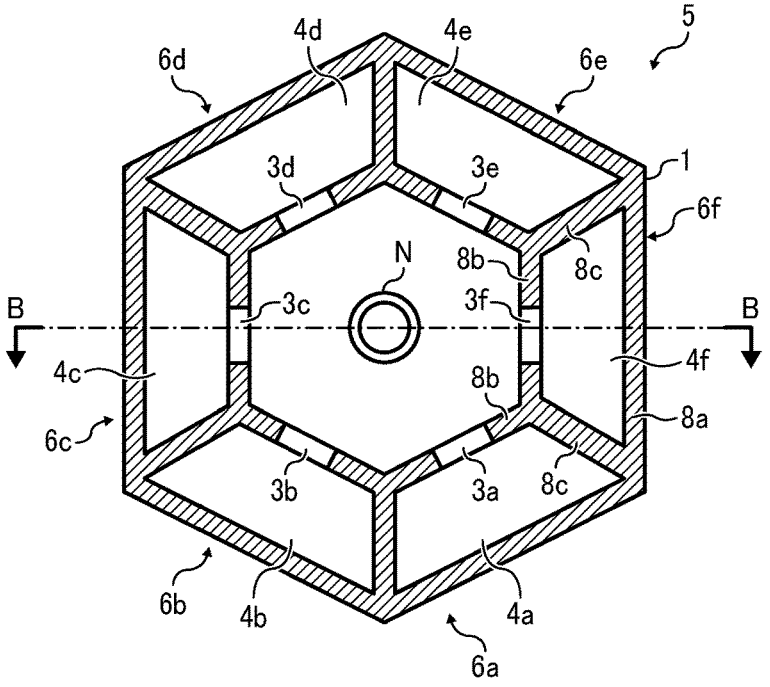

Next, an acoustic device 5 according to a fourth embodiment is described. FIGS. 12A and 12B illustrate the acoustic device 5 according to the fourth embodiment, in which FIG. 12A is a side cross-sectional view of the acoustic device 5, and FIG. 12B is a cross-sectional view along A-A cross-section in FIG. 12A. In addition, FIG. 12A is a cross sectional view along B-B cross-section in FIG. 12B. The acoustic device 5 according to the fourth embodiment illustrated in FIGS. 12A and 12B includes a cavity forming member 1 made of a resin material and a cover member 2 made of a metal plate, which are joined together.

The acoustic device 5 according to the fourth embodiment includes six Helmholtz resonators 6 (from a first to sixth resonators 6*a* to 6*f*), each including a set of cavity forming member 1 and cover member 2. The acoustic device 5 according to the fourth embodiment is configured such that, as illustrated in FIG. 8B, each of the plurality of Helmholtz resonators is disposed in a polygonal shape or a hexagonal shape to thereby surround the sound source mount position N. The cavity forming member 1 made of the resin material surrounds a periphery of the sound source mount position N.

The acoustic device 5 according to the fourth embodiment is similar to the acoustic device 5 according to the first embodiment except for the polygonal shape, and can absorb effectively the sound that the drive motor 50 disposed inside the acoustic device 5 emits similarly to the case of the first embodiment. In addition, if the sound source has a complicated shape such as the polygonal shape, a distance between the surface of an inner side wall 8*a* opposite the sound source mount position N in the cavity forming member 1 that surrounds the sound source mount position N and the sound source can be kept constant. Further, the distance from the sound source such as the drive motor 50 disposed at the sound source mount position N to the plurality of ports 3 can be kept constant.

The above acoustic devices 5 according to the first to fourth embodiments each include the port 3 open toward an inner side so as to absorb the sound from the sound source disposed at a center of the device. To provide a structure to absorb an environmental sound of the acoustic device 5, each port 3 of the plurality of Helmholtz resonators 6 disposed in the peripheral direction can be oriented outward.

Figure 13:
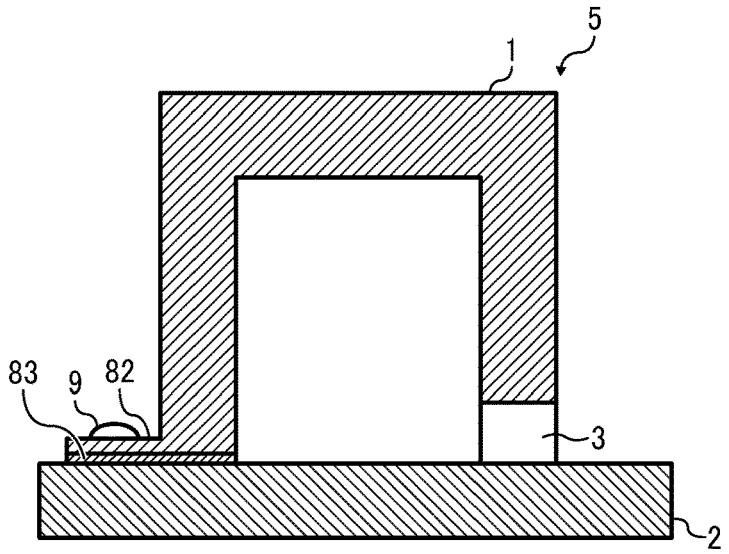
FIG. 13 illustrates the acoustic device in which an elastic member is disposed at a joint portion between a cavity forming member and a cover.

FIG. 13 illustrates an acoustic device 5 according to the present embodiment including a cavity forming member 1 and a cover member 2, and an elastic member 83 disposed at a joint portion between the cavity forming member 1 and the cover member 2. As illustrated in FIG. 13, the elastic member 83 is interposed at the joint portion, to thereby improve sealing performance of the cavity 4 and the sound absorbing performance.

In the present embodiments, a case in which the electronic device including the acoustic device is an image forming apparatus employing the electrophotographic method. However, as far as a structure includes a sound source generating the sound during operation and an acoustic device to absorb the sound emitted from the sound source, embodiments of the present invention may be applied to any electronic device other than the image forming apparatus.

Exemplary embodiments of the present invention provide the following effects, not exhaustive, based on each aspect of the present disclosure.

Aspect A

An acoustic device 5 includes a first member such as a cavity forming member 1; a second member such as a cover member 2; a cavity 4 formed with the cavity forming member 1 and the cover member 2 joined together; and an open portion such as a port 3 to communicate the cavity with an outside. The port 3 is disposed at a joint portion between the first member and the second member. With this structure, as described in the exemplary embodiments, hole making process to prepare an opening relative to the member to form the acoustic device is not necessary due to the following reason. Specifically, a concave part such as a cutout portion 190 is disposed at least at a joint surface of the first member such as an edge face 19 of the cavity forming member to form the joint portion, or a joint surface of the second member such as an opposite face 23 of the cover member, and the cutout portion 190 does not contact the other joint surface when the first member and the second member are joined together. With this structure, due to the gap between the concave portion and the other joint surface opposite the concave portion, an opening is formed at the joint portion. Then, the concave portion forms a part of the joint surface of the member including the concave portion and can be formed simultaneously when the joint surface is formed by projection molding, to thereby make it unnecessary to perform a hole making process. As a result, Aspect A can eliminate the hole making process to form an opening to the member that forms the acoustic device, thereby preventing an increase in the number of processes in manufacturing.

Aspect B

In Aspect A, part of the face extending in an opening direction of the port 3 is the same planar surface as part of the face (that is, the opposite face 23 of the cover member) that forms the cavity 4. With this structure, as described in the above embodiments, a new process needs not be provided to form an opening relative to the member (that is, the cover member 2) to form a face of the cavity being the same planar surface as a part of the face of the opening, and the member including the planar surface may be used as is.

Aspect C

In either Aspect A or B, the acoustic device includes the first member such as the cavity forming member 1 made of a resin material, a bottom plate 7 disposed opposite the second member such as the cover member 2 with the cavity 4 in between, and a side wall 8 extending from the bottom plate 7 to the second member. An edge portion of the side wall of the first member opposite the bottom plate (such as the edge face 19 as the cavity forming member) is joined to the second member, to thereby join the first member and the second member together. The acoustic device further includes a concave shape such as a cutout portion 190 forming an opening such as the port 3 by joining the second member to a part of an edge portion of the side wall, opposite the bottom plate. With this structure, as described in the above embodiments, when the first member is formed by projection molding, the first member with a complicated shape including the bottom plate, the side wall, and the concave portion that forms an opening can be formed with a pair of metal molds alone separable in an extending direction of the side wall.

Aspect D

In Aspect C, the first member such as the cavity forming member 1 includes the side wall 8 including a first side wall vertically extending upwards from one face of the bottom plate 7 (that is, an upper face of the bottom plate 7 in FIG. 10B) and a second side wall vertically extending downwards from the other face of the bottom plate (that is, a bottom face of the bottom plate 7 in FIG. 10B), each of the edge face on the side opposite each bottom plate in the first side wall and the second side wall is joined with the other second member (that is, the open cover member 220 and the non-open cover member 210), respectively, to thereby form a different cavity 4 from each other. By joining the second member to a part of the edge face of each of the first side wall and the second side wall, a concave shape such as the cutout portion 190 to form an opening of the port 3 is provided. With this structure, as described in the third embodiment, the first member forming the acoustic device such as a two-level Helmholtz resonators 6 with the bottom plate in between can be formed with a pair of metal molds alone that is separable in the extending direction of the side wall.

Aspect E

In either Aspects B to D, the acoustic device is configured such that at least one of the first member such as the cavity forming member 1 and the second member such as the cover member 2 surrounds an periphery of the device center portion such as the sound source mount position N ranging from 180 degrees or more and below 360 degrees, that is, 300 degrees, for example. With this structure, as described in the second embodiment, if the periphery of the device center portion ranging 180 degrees or more is surrounded with the sound source disposed at the device center portion, the sound source can be surrounded, and the sound is absorbed inside the surrounded shape, so that the sound can be absorbed effectively. In addition, because the area of the surrounding shape is set to below 360 degrees and an open portion is disposed at a part in the periphery, a temperature rise inside the surrounded shape can be restricted.

Aspect F

In either Aspects B to D, the acoustic device is configured such that at least one of the first member such the cavity forming member 1 and the second member such as the cover member 2 surrounds an entire periphery of the device center portion such as the sound source mount position N. With this structure, as described in the first embodiment, the sound source disposed at a center of the device is surrounded when surrounding the entire periphery of the device center portion, and the sound is absorbed inside the surrounded shape, so that the sound can be absorbed effectively.

Aspect G

In either Aspect E or F, the member surrounding the device center portion such as the sound source mount position N is a circular arc shape or a circular shape. With this structure, as described in the first and second embodiments, the acoustic device can realize the shape that surrounds the device center portion. The surface (of the inner side wall 8*a*) of the member that surrounds the device center portion, opposite the device center portion, can be formed with an arc-shaped curved surface, and the distance from the sound source such as the drive motor disposed at the device center portion to the member that surrounds the device center portion can be kept constant.

Aspect H

In either Aspect E or F, the member that surrounds the device center portion such as the sound source mount position N has a polygonal shape such as a hexagonal shape. With this structure, as described in the fourth embodiment, the acoustic device can realize a shape to surround the device center portion. In addition, even in a case in which the sound source such as the drive motor disposed at the device center portion has a complicated shape, the distance between the face of the member surrounding the device center portion, opposite the device center portion, and the sound source can be kept constant. Further, in a structure including the plurality of ports 3, the distance from the sound source such as the drive motor positioned at the drive center portion to each port can be kept constant.

Aspect I

In either Aspect E or F, a plurality of sets of the cavity 4 and the port 3 is disposed in the peripheral direction of the device center portion of the sound source mount position N. With this structure, as described in the above embodiments, the plurality of Helmholtz resonators 6 each serving as a sound absorbing part can realize a structure to surround the sound source. In addition, frequencies of the sound as a sound absorbing target of the plurality of sound absorbing parts are different from each other, so that the sound including various frequencies can be absorbed.

Aspect J

In Aspect I, the port 3 is open toward the device center portion such as the sound source mount position N. With this structure, as described in the above embodiment, each opening of the sound absorbing parts such as the plurality of Helmholtz resonators 6 is oriented to the device center portion. As a result, when the sound source is disposed at the device center portion, the sound can be absorbed effectively.

Aspect K

In either one of Aspects E to J, a drive transmitter such as a planet gear is disposed in the device center portion such as the sound source mount position N. With this structure, the sound emitted from the drive transmitter can be effectively absorbed.

Aspect L

In either Aspects E to J, a drive output device such as the drive motor 50 is disposed at the device center portion such as the sound source mount position N. With this structure, as described in the above embodiment, the sound emitted from the drive output device can be effectively absorbed.

Aspect M

In either Aspect K or L, a drive transmitter such as the planet gear and the rotary shaft 51 of the drive output device such as the drive motor 50 is positioned at the device center portion such as the sound source mount position N. With this structure, as described in the above embodiments, friction sound generated due to friction with other parts when the rotary shaft 51 rotates can be effectively absorbed.

Aspect N

In either one of Aspects A to M, a material (a metal) for the second member such as the cover member 2 has a density greater than that of a material (a resin) for the first member such as the cavity forming member 1. With this structure, as described in the above embodiments, because the second member is formed of the metal with the density greater than that of the resin, a structure to restrict a penetrating sound to penetrate in the depth direction of the second member can be realized. In addition, because the first member is made of resins that can be processed more easily than the metal, while keeping the sealing property, the cavity can be formed with high precision. In addition, because an opening such as a port 3 is disposed at the joint portion, the sound reflected by the second member formed of the higher density material, and the sound transmitted along such port 3 of the second member can be effectively absorbed.

Aspect O

In either one of Aspects A to N, the first member such as the cavity forming member 1 includes a bottom plate 7 opposite the second member such as the cover member 2 with the cavity 4 in between, and a side wall 8 extending from the bottom plate to the second member, in which an edge face opposite the bottom plate of the side wall (that is, the edge face 19 of the cavity forming member) contacts a planar portion of the second member (that is, the opposite face 23 of the cover member) , to thereby from a cavity, and the planar portion of the second member incudes a projected portion 230 of the opposite face of the cover member, that is, the projected portion 230 projects outwards than the side wall forming a part including the port at the joint portion. With this structure, as described in the above embodiment, because the opening such as the port 3 is disposed on the side wall, to which the sound reflected by the projected portion of the planar face of the second member, is incident, the sound can be effectively absorbed.

Aspect P

An acoustic device includes a first member such as a cavity forming member 1, a second member such as a cover member 2, a cavity 4 formed by joining together the first member and the second member, and an opening such as a port 3 to communicate the cavity and an outside, in which the first member includes a bottom plate 7 opposed to the second member with the cavity in between, and a side wall 8 extending from the bottom plate toward the second member. An edge face of the side wall, opposite the bottom plate, that is, an edge face 19 of the cavity forming member, contacts the second member, to thereby form the cavity. The acoustic device further includes a hole 191 that penetrates the side wall. The material of the second member is a metal, which has a greater density than a resin material of the first member. With this structure, as described in the second modification, an incident sound reflected by the second member as the cover member that tends to be a reflected sound and the sound transmitted along the surface of the side wall can be effectively absorbed.

Aspect Q

An acoustic device 5 includes a first member such as a cavity forming member 1, a second member such as a cover member, a cavity 4 formed by joining together the first member and the second member, and an opening such as a port 3 to communicate the cavity to an outside, in which the first member includes a bottom plate opposed to the second member with the cavity in between, a side wall 8 extending from the bottom plate toward the second member. An edge face of the side wall, opposite the bottom plate, that is, an edge face 19 of the cavity forming member, contacts a planar portion of the second member, that is, an opposite face 23 of the cover member, to thereby form the cavity. The acoustic device further includes a hole 191 that penetrates the side wall, and a planar portion of the second member includes a projected portion 230 of the opposite face of the cover member. The projected portion 230 projects outward than the side wall in which the hole is provided. With this structure, as described in the first modification, because the port 3 is disposed on the side wall, to which the sound reflected by the projected portion of the planar face of the second member is incident, the sound can be effectively absorbed.

Aspect R

In either Aspect P or Q, the hole 191 is disposed at a position nearer to a joint portion between the first member such as the cavity forming member 1 and the second member than to a center of the side wall extending from the bottom plate 7 to the second plate such as the cover member 2. With this structure, as described in the first and second modifications, the sound reflected by the surface of the second member and the sound transmitted along the surface of the second member can be effectively absorbed.

Aspect S

In either one of Aspects A to R, the first member such as the cavity forming member 1 and the second member such as the cover member 2 are fastened with fastening screws 9. With this structure, as described in the above embodiment, fastening of the first and second members can be performed at a low-cost structure. In addition, due to the pressure caused by the screw-fastening, at least one of the first member and the second member elastically deforms, so that one member deforms along the surface of the other member at the joint portion between the both members, to thereby prevent a gap from generating at the joint portion. Accordingly, reduction in the acoustic effect caused by the gap generating at the joint portion between the members to form the cavity 4 may be prevented at a low-cost structure.

Aspect T

In any of Aspects A to S, an elastic member 83 is disposed between the first member such as the cavity forming member 1 and the second member such as the cover member 2. With this structure, as described in the above embodiment, sealing performance of the cavity 4 is improved, thereby improving acoustic performance.

Aspect U

In an electronic device such as a copier 500 including an acoustic device to absorb sound during operation, an acoustic device 5 according to either one of Aspects A to T is disposed. With this structure, as described in the above embodiment, the sound of the electronic device during operation is absorbed by the acoustic device such as a Helmholtz resonator 6, thereby reducing a number of processes during manufacturing.

Aspect V

In an image forming apparatus employing the electrophotographic method such as the copier 500, a structure of the electronic device as described in Aspect U is disposed. With this structure, as described in the above embodiment, the sound generated in the image forming apparatus during operation is absorbed by the acoustic device such as the Helmholtz resonator 6, thereby preventing a number of processes in manufacturing from increasing.

Additional modifications and variations of the present disclosure are possible in light of the above teachings. It is therefore to be understood that, within the scope of the appended claims, the embodiments of the present invention may be practiced other than as specifically described herein.

What is claimed is:

1. An acoustic device comprising:

a plurality of adjacent sound absorbing parts, each of the plurality of adjacent sound absorbing parts including, a first member, a second member, a cavity formed by joining the first member and the second member together, and a communication portion at a joint portion between the first member and the second member to communicate the cavity of a respective one of the plurality of adjacent sound absorbing parts with an outside, wherein each of the plurality of adjacent sound absorbing parts includes only one cavity and only one communication portion, and the plurality of adjacent sound absorbing parts surround a center portion of the acoustic device so that the communicating portion of each of the plurality of adjacent sound absorbing parts is oriented to the center portion of the acoustic device.

2. The acoustic device according to claim 1, wherein the communication portion includes a face extending in an opening direction of the communication portion, and a part of the face is on the same plane as a part of a face forming the cavity.

3. The acoustic device according to claim 1, wherein the first member, made of a resin material, comprises:

a bottom plate disposed opposite the second member with the cavity in between;

a side wall extending from the bottom plate to the second member, wherein an edge portion of the side wall of the first member opposite the bottom plate is joined to the second member, to join the first member and the second member together; and a concave portion disposed at a part of a joint surface of the first member, to join the second member to form the communication portion.

4. The acoustic device according to claim 3, wherein:

the first member includes the side wall including a first side wall vertically extending upwards from one face of the bottom plate and a second side wall vertically extending downwards from another face of the bottom plate, an edge face of the first side wall opposite the bottom plate and an end face of the second side wall opposite the bottom plate are joined to separate portions of the second member to form different cavities; and the concave portion is disposed at a portion of the edge face of each of the first side wall and the second side wall, to join the second member to form the communication portion.

5. The acoustic device according to claim 1, wherein at least one of the first member and the second member surrounds a peripheral area of a center portion of the acoustic device, the peripheral area ranging from 180 degrees or more to less than 360 degrees.

6. The acoustic device according to claim 1, wherein at least one of the first member and the second member surrounds an entire area of a periphery of a center portion of the acoustic device.

7. The acoustic device according to claim 5, wherein the at least one of the first member and the second member surrounding the center portion of the acoustic device has a circular arc shape.

8. The acoustic device according to claim 5, wherein the at least one of the first member and the second member surrounding the center portion of the acoustic device has a polygonal shape.

9. The acoustic device according to claim 5, wherein a plurality of sets of the cavity and the communication portion is disposed in a peripheral direction of the center portion of the acoustic device.

10. The acoustic device according to claim 9, wherein the communication portion is open toward the center portion of the acoustic device.

11. The acoustic device according to claim 5, further comprising:

at least one of a drive transmitter; and a drive output device, wherein a rotary shaft of the drive transmitter or the drive output device is disposed at the center portion of the acoustic device.

12. An acoustic device comprising:

a first member;

a second member;

a cavity formed by joining the first member and the second member together; and a single communication portion at a joint portion between the first member and the second member to communicate the cavity with an outside such that the cavity is configured to communicate with the outside only through the single communication portion, wherein a material of the second member has a density greater than a density of a material of the first member.

13. The acoustic device according to claim 1, wherein:

the first member includes a bottom plate disposed opposite the second member with the cavity in between, and a side wall extending from the bottom plate to the second member; and an edge face of the side wall opposite the bottom plate contacts a planar portion of the second member, to form the cavity, and the planar portion of the second member projects further outwards than the side wall forming a part including the communication portion at the joint portion.

14. An acoustic device comprising:

a first member;

a second member;

a cavity formed by joining the first member and the second member together; and a communication portion to communicate the cavity with an outside, wherein the first member includes a bottom plate opposed to the second member with the cavity in between and a side wall extending from the bottom plate toward the second member, an edge face of the side wall, opposite the bottom plate, contacts the second member, to thereby form the cavity, the communication portion includes a hole that penetrates the side wall, and a material of the second member has a density greater than a density of a material of the first member.

15. The acoustic device according to claim 14, wherein the hole is disposed at a position nearer to a joint portion between the first member and the second member than to a center of the side wall extending from the bottom plate to the second member.

16. An acoustic device comprising:

a plurality of adjacent sound absorbing parts, each of the plurality of adjacent sound absorbing parts including, a first member, a second member, a cavity formed by joining the first member and the second member together, and a communicating portion disposed at a joint portion between the first member and the second member to communicate the cavity to an outside, wherein, in at least one of the plurality of adjacent sound absorbing parts, the first member includes a bottom plate opposed to the second member with the cavity in between, and a side wall extending from the bottom plate toward the second member, an edge face of the side wall, opposite the bottom plate, contacts a planar portion of the second member to form the cavity, the communication portion includes a hole that penetrates the side wall, and a planar portion of the second member projects further outward than the side wall having the hole, and the plurality of adjacent sound absorbing parts surround a center portion of the acoustic device so that the communicating portion of each of the plurality of adjacent sound absorbing parts is oriented to the center portion.

17. The acoustic device according to claim 1, wherein each of the plurality of adjacent sound absorbing parts further includes fastening screws to fasten the first member and the second member together.

18. The acoustic device according to claim 1, wherein each of the plurality of adjacent sound absorbing parts further includes an elastic member disposed between the first member and the second member.

19. An electronic device comprising the acoustic device according to claim 1.

20. An image forming apparatus employing an electrophotographic method, comprising the electronic device according to claim 19.

21. An acoustic device comprising:

a first member;

a second member; and a plurality of adjacent sound absorbing parts formed by joining the first member and the second member together, each of the plurality of adjacent sound absorbing parts including a cavity and a communicating portion, the communicating portion being at a joint between the first member and the second member to communicate only the cavity of a respective one of the plurality of adjacent sound absorbing parts with an outside, the plurality of adjacent sound absorbing parts disposed surrounding a periphery of a center portion of the acoustic device, wherein each of the plurality of adjacent sound absorbing parts includes only one cavity and only one communicating portion, and at least one of the first member and the second member surrounds a center portion of the acoustic device so that the communicating portion of each of the plurality of adjacent sound absorbing parts is oriented to the center portion.

22. The acoustic device according to claim 1, wherein the communication portion includes a face extending in an opening direction of the communication portion, and a part of the face is on the same plane as a part of a face forming the cavity.

23. The acoustic device according to claim 21, wherein the first member, made of a resin material, comprises:

a bottom plate disposed opposite the second member with each cavity in between;

a side wall extending from the bottom plate to the second member, wherein an edge portion of the side wall of the first member opposite the bottom plate is joined to the second member, to join the first member and the second member together; and a concave portion disposed at a part of a joint surface of the first member, to join the second member to form each communication portion.

24. The acoustic device according to claim 21, wherein a material of the second member has a density greater than a density of a material of the first member.

25. The acoustic device according to claim 21, wherein:

the first member includes a bottom plate disposed opposite the second member with each cavity in between, and a side wall extending from the bottom plate to the second member; and an edge face of the side wall opposite the bottom plate contacts a planar portion of the second member, to form each cavity, and the planar portion of the second member projects further outwards than the side wall forming a part including each communication portion at a joint portion.

26. An electronic device comprising the acoustic device according to claim 21.

27. An image forming apparatus employing an electrophotographic method, comprising the electronic device according to claim 26.

* * * * *